United States Patent [19]

Takeuchi

[11] Patent Number: 4,622,706

[45] Date of Patent: Nov. 18, 1986

[54] AIR MAT APPARATUS

[75] Inventor: Masatoshi Takeuchi, Anan, Japan

[73] Assignee: Seiken Co., Ltd., Tokushima, Japan

[21] Appl. No.: 653,092

[22] Filed: Sep. 21, 1984

[30] Foreign Application Priority Data

Oct. 11, 1983 [JP] Japan ..... 58-190214

[51] Int. Cl.[4] ..... A47C 27/08; A61H 1/00

[52] U.S. Cl. ..... 5/453; 5/455; 128/33

[58] Field of Search ..... 5/441, 449, 453, 455, 5/456; 128/33, 38, 40

[56] References Cited

U.S. PATENT DOCUMENTS

| | | | |
|---|---|---|---|
| 1,608,239 | 11/1926 | Rosett | 5/456 |
| 2,460,245 | 1/1949 | Summerville | 128/33 |
| 3,242,511 | 3/1966 | Fultz et al. | 5/441 |
| 3,605,138 | 9/1971 | Tucker | 5/456 |
| 3,653,083 | 4/1972 | Lapidus | 128/33 |
| 4,472,847 | 9/1984 | Gammons et al. | 5/453 |

FOREIGN PATENT DOCUMENTS

| | | | |
|---|---|---|---|
| 2107197 | 4/1983 | United Kingdom | 5/453 |

*Primary Examiner*—Thomas J. Holko
*Assistant Examiner*—Michael F. Trettel
*Attorney, Agent, or Firm*—Wenderoth, Lind & Ponack

[57] ABSTRACT

In an air mat apparatus comprising a mat body having a plurality of defined air chambers, there is an air source for feeding air to each of the air chambers of the mat body and a changeover valve connected between the mat body and the air source for controlling the air feed from the air source to each of air chambers. An air-containing elastic layer is laid on the upper surface of the mat body. The air-containing elastic layer has such an elasticity and is provided with numerous voids which can suck air into the inside and which are open to the outer air so that the air-containing elastic layer is made to discharge and suck air when the air chambers are inflated and deflated whereby compulsory ventilation is achieved between the mat body and the body surface of the user.

The present invention relates to an air mat apparatus which is mainly laid on a bed or chair or wound round a hand or leg in order to promote the blood circulation of the body surface to prevent bedsores or to massage the waist, back, hand, leg or the like.

4 Claims, 54 Drawing Figures

FIG.29
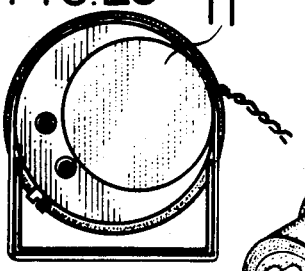
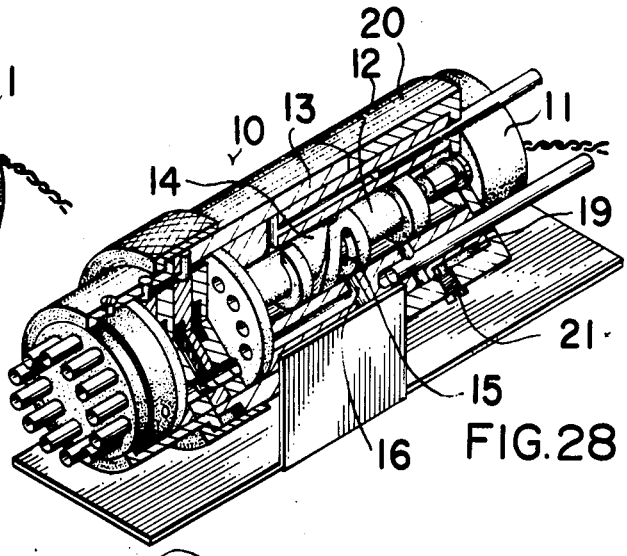
FIG.28
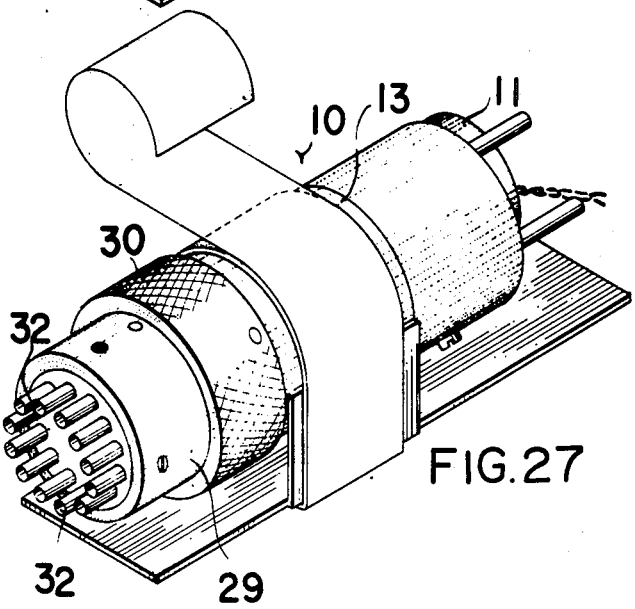
FIG.27

FIG.39 (3)
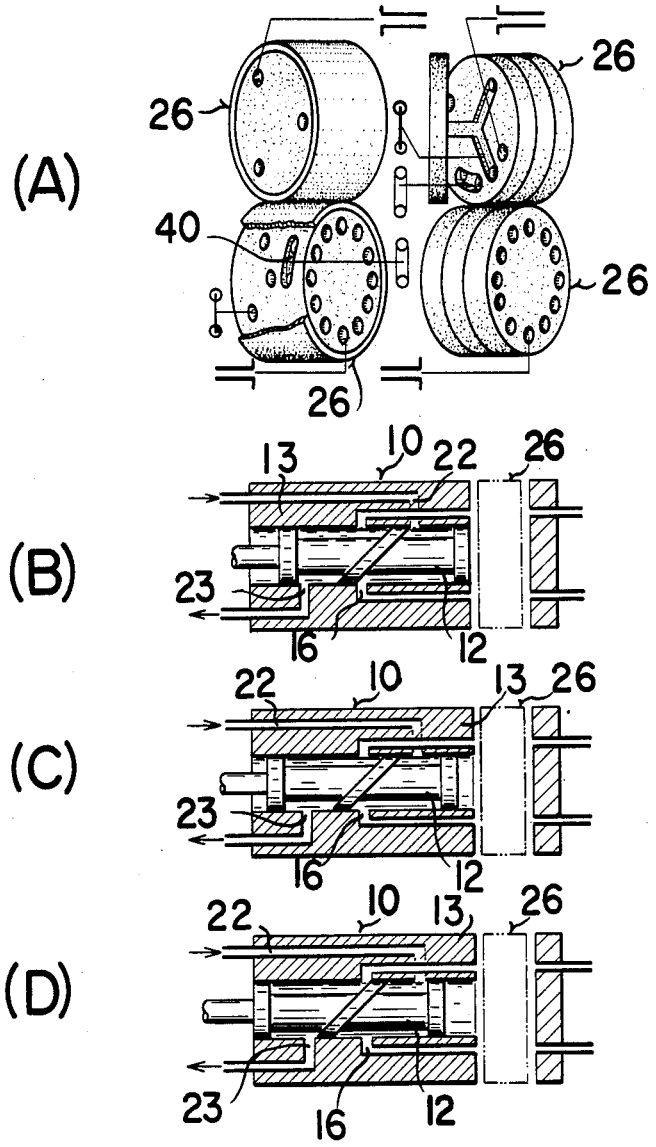

FIG.44 (2)
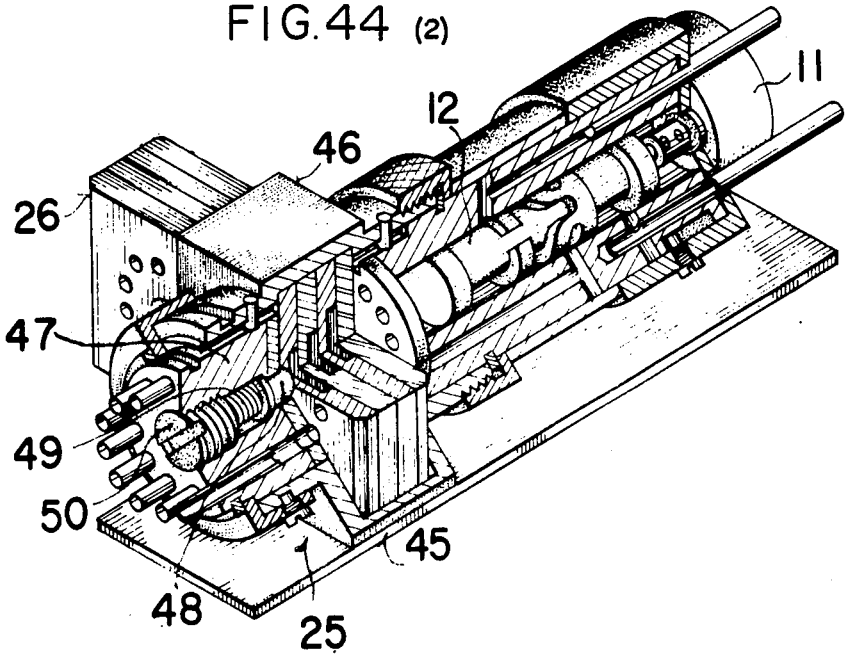

AIR MAT APPARATUS

BACKGROUND OF THE INVENTION

An air mat in which compressed air is introduced into an airtight bag has been already put to practical use. However, an air mat, the whole surface of which is always stretched by air pressure, hinders the blood circulation of the human body surface when used. This disadvantage is not limited to such an air mat but also an air mat formed of urethane foam has the same disadvantage. Therefore, patients who cannot move on the bed, e.g., those in serious illness or affected by an atrophy of muscles, have bedsores and suffer from the weakening of internal organs, especially digestive organs like intestines.

In order to prevent bedsores, air mats have been developed in which a number of slender air bags are provided in a grid-like arrangement, and they are inflated and deflated by controlling the air supply thereinto. (Japanese Utility Model Provisional Publication Nos. 5609/76, 164393/77, 69194/78, 98793/78, and 95596/78).

In order to obtain a sufficient massaging effect by means of such air mats, patients have to lie down directly on the air mat. However, if the patient lies down directly on the air mat, a sufficient ventilation cannot be achieved between the air mat and the body surface of a patient. As the result, disadvantageously, the body surface of the patient becomes wet with prespiration after a long use of the air mat.

An apparatus has been developed in which small holes are provided in the air mat so that air for inflating the air mat can be discharged out through the holes and thereby a compulsory ventilation can be achieved between the air mat and the body surface of the patient (Japanese Utility Model Provisional Publication No. 56096/76). However, with this structure, compressed air fed by a compressor is excessively discharged out of the portion of the mat where the body weight of the patient is not applied. Thus, air is wasted without being used for the ventilation between the human body and the mat. Further disadvantageously with this structure, the body of the patient is put into contact with cold air and is apt to be chilled in winter.

SUMMARY OF INVENTION

An object of the present invention is to obviate the abovementioned disadvantages of the conventional air mat apparatus, by providing an air mat apparatus in which an air-containing elastic layer capable of sucking in and discharging out a sufficient amount of air is laid on a mat body.

An important object of the present invention is to provide an air mat apparatus in which air can be compulsorily ventilated between the mat body and the body surface of the patient each time the air mat is inflated or deflated; only a small amount of air is exhausted since all air is not discharged out of the mat body; a number of mat bodies can be driven by a compression of small capacity; and further, the patient using the air mat apparatus is not chilled even in winter.

The above objects and novel features of the invention will more fully appear from the following detailed description when read in connection with the accompanying drawing. It is to be expressly understood, however, that the drawing is for purpose of illustration only and is not intended as a definition of the limits of the invention.

Now, examples of the present invention will be described with reference to the appended drawings.

BRIEF DESCRIPTION OF THE DRAWINGS

FIGS. 27 and 28 are perspective and partly sectioned perspective views of the changeover valve;

FIG. 29 is a back view of the changeover valve;

DETAILED DESCRIPTION OF THE PREFERRED EMBODIMENTS

Figure 1:
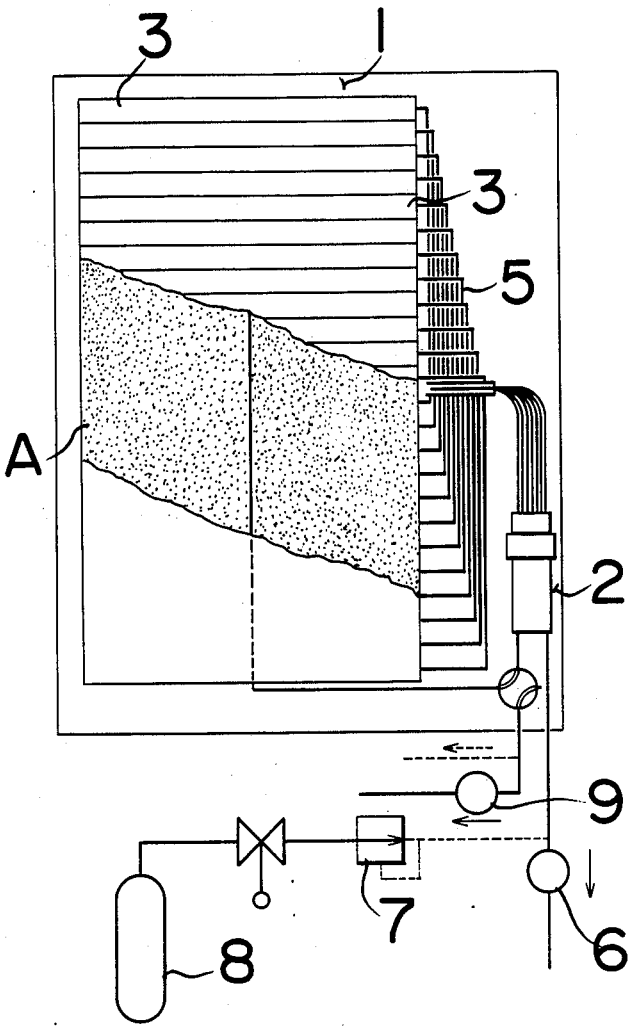
FIG. 1 is a plan view of an example of the air mat apparatus according to the present invention.

The mat body 1 shown in FIG. 1 comprises a mat body 1, an air-containing elastic layer A laid on the mat body 1, an air source for feeding the mat body 1 with compressed air and a changeover valve 2 connected between the air source and the mat body 1.

Figure 2:
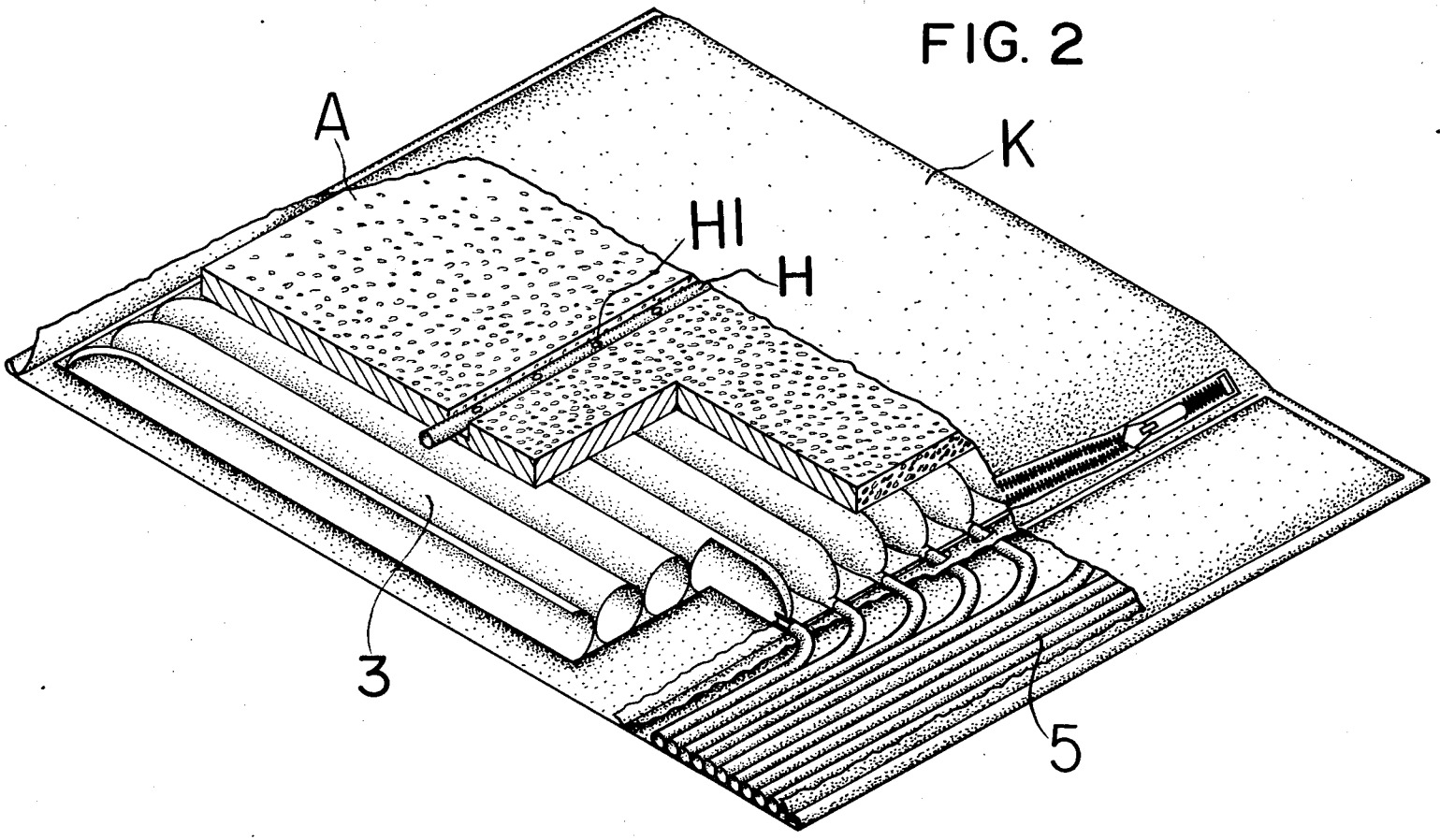
FIG. 2 is a partially sectioned perspective view of the mat body.

The mat body 1 comprises a plurality of tubular air bags 3 each defining an air chamber. The tubular air bags are arranged in a grid-like manner as shown in FIGS. 1 and 2. The tubular air bags 3 are formed of a flexible and airtight material so that they can be inflated when pressurized air is introduced thereinto and deflated when air is discharged therefrom, e.g. cloth coated with synthetic resin or flexible synthetic resin sheet. The tubular air bags 3 are flexible so that they can be inflated with the introduction of pressurized air thereinto, but preferably they are so strong as not to be elongated in this condition. If the tubular air bags 3 have an expanded capacity with the introduction of air thereinto but are not elongated, they have constant dimensions in spite of the change of the pressure of air introduced therein. The tubular air bags 3 then have have sufficient strength and durability. The preferred demensions of the tubular air bags 3 are decided to be optimum valves in accordance with the purposes of use but usually the outer diameter of the inflated tubular air bag 3 is selected as 2 to 10 centimeters while the length thereof is about 30 to 150 cm.

Figure 3:
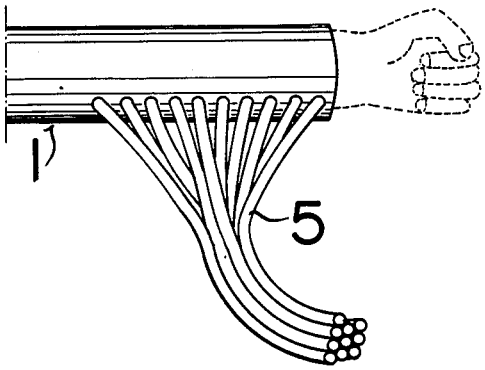
FIGS. 3 and 4 are side and plan views of the mat body to be wound round the arm.
Figure 4:
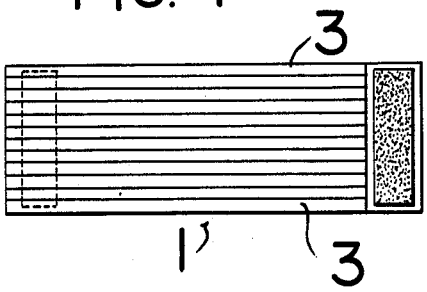

Since the mat body 1 is to be wound round an arm as shown in FIG. 3 or a leg (not shown), the tubular air bags 3 are arranged a grid-like manner as shown in FIG. 4 so that each tubular air bag 3 is wound round the arm or leg, that is, the tubular air bags 3 are positioned in the lateral direction with respect to the length of the arm or leg.

Figure 5:
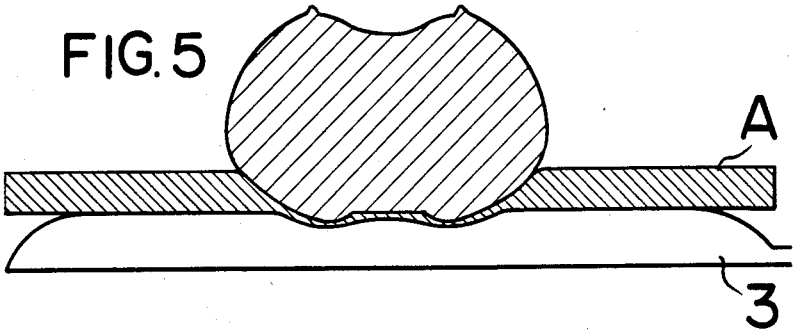
FIGS. 5 to 10 are sectional views showing the mat body when compressed by the human body surface.
Figure 6:
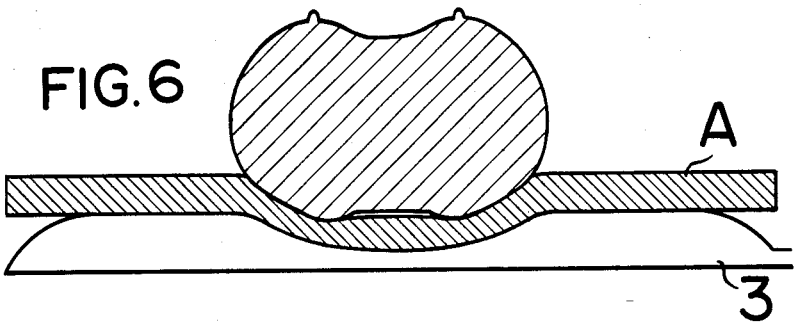

As shown in FIGS. 5 and 6, the air-containing elastic layer A is formed of such an elastic material that it can be depressed when the tubular air bags 3 are inflated and can be expanded when the latter is deflated. Such an elastic material is required to have numerous voids in its own inside so that it can contain a sufficient amount of air when it is inflated. Further, the voids need to be open to the atmosphere so that air can freely go in and out. Thus, the air-containing elastic layer A is formed of, for example, continuously foamed elastic synthetic resin such as soft polyurethane foam or non-woven fabric consisting of three-dimensionally accumulated synthetic fibers.

The thickness of the air-containing elastic layer A is decided in accordance with the diameter of the tubular air bags 3, required massage effect, necessary ventilation volume or the like, but it is usually selected as 0.5 to a few centimeters and preferably about 1 to 5 cm.

The air-containing elastic layer A is depressed between the tubular air bags 3 and the body surface of the patient when the tubular air bags 3 are inflated with the introduction of pressurized air thereinto as shown in FIG. 5, and in this condition, air contained in the air-containing elastic layer A is discharged out. When the tubular air bags 3 are put to be open to the outer air, they are depressed by the elasticity of the air-containing elastic layer A as shown in FIG. 6, and air is sucked into numerous voids of the air-containing elastic layer A.

Figure 7:
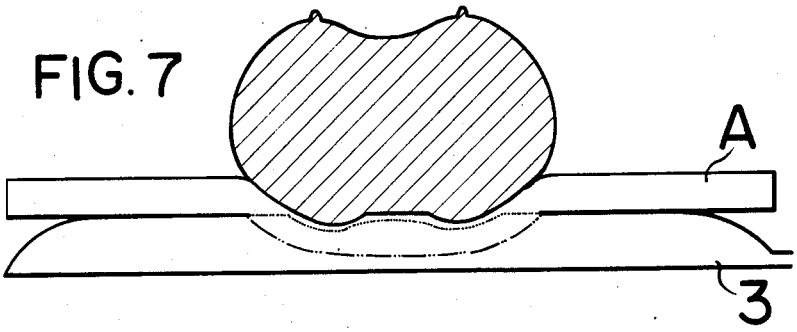

With the inflation and deflation of the tubular air bags 3, air is sucked in and discharged out of only the capacity defined by the dotted line and double-dotted chain line shown in FIG. 7, and thus ventilation is performed there.

If air is compulsorily discharged out of the tubular air bags 3 by an air discharge pump, the tubular air bags 3 are wholly deflated. On the contrary, when air is discharged out of the tubular air bags 3 open to the atmosphere by means of the elasticity of the air-containing elastic layer A air is discharged first from the portion below the human body surface as shown in FIGS. 6 and 7 and almost the whole amount of air in the position not below the human body surface remains so that air consumption can be decreased.

As shown in FIG. 2, when a discharge pipe H is put in the upper surface of the air-containing elastic layer A and air outlet openings H1 are provided there, air discharged out of the tubular air bag 3 is effectively reused for ventilation.

Figure 8:
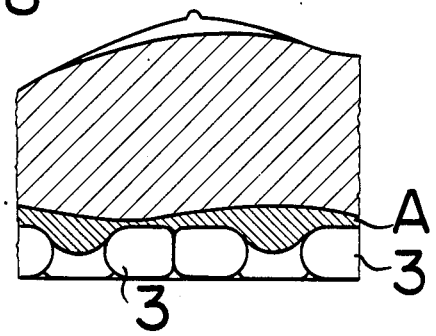
Figure 9:
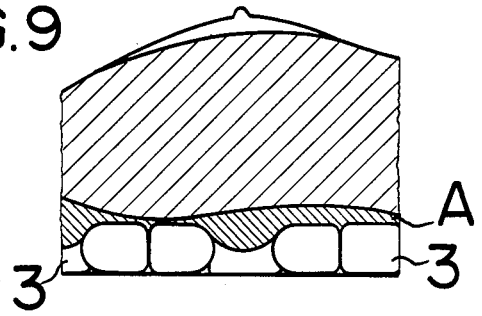
Figure 10:
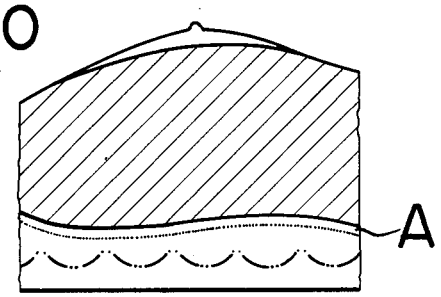

As shown in FIGS. 8 and 9, when the inflation and deflation of each tubular air bag 3 is repeated, the wave motion of the tubular air bags 3 is transmitted. With the wave motion of each tubular air bag 3, the space defined by the dotted line and the double dotted chain line in FIG. 10 is ventilated.

Figure 11:
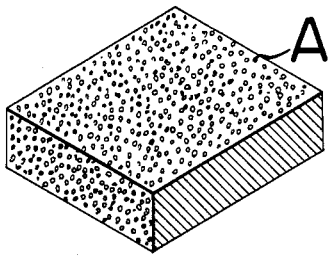
FIGS. 11, 14, 17 and 20 are perspective views showing the air-containing elastic layer.
Figure 12:
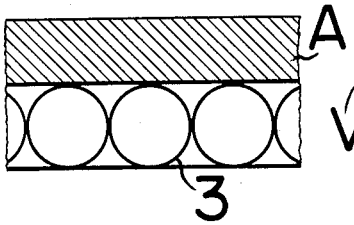
FIGS. 12, 15, 18 and 21 are sectional and perspective views showing the air-containing elastic layer mounted on the tubular air bags.
Figure 13:
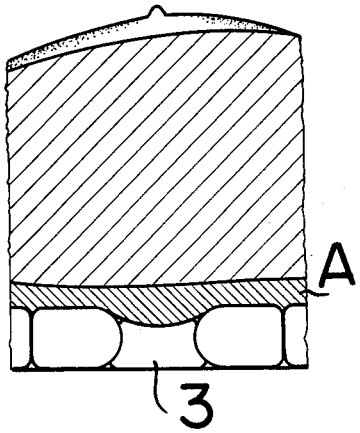
FIGS. 13, 16, 19 and 22 are sectional and perspective views of the air-containing elastic layer in the compressed state.

The lower surface of the air-containing elastic layer A is flat as shown in FIGS. 11 and 12. Therefore, if the contact surface of the air-containing elastic layer A with the deflated tubular air bags 3 cannot be sufficiently extended, the air-containing elastic layer A is not so compressed against the deflated tubular air bags 3 as to absolutely depress the tubular air bags 3 so as shown in FIG. 13.

Examples for obviating such an disadvantage are shown in FIGS. 14 to 22.

Figure 14:
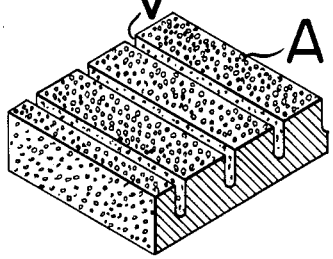
Figure 15:
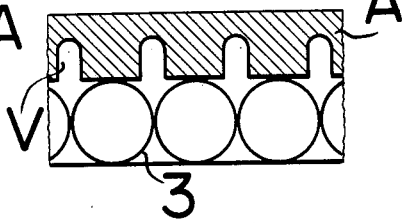
Figure 16:
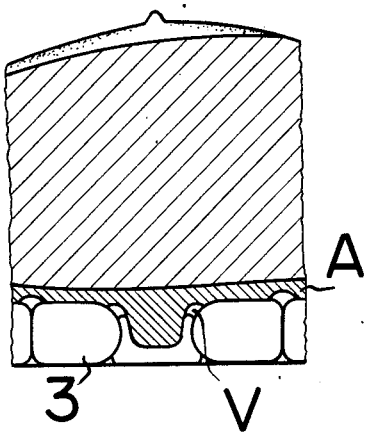

The air-containing elastic layer A shown in FIGS. 14 and 15 are provided with channels V parallel with the tubular air bags 3 and with the same pitch as that of the tubular air bags 3. Preferably, the channels V are respectively aligned in accordance with the spaces between the tubular air bags 3 as shown in FIGS. 15 and 16.

Figure 17:
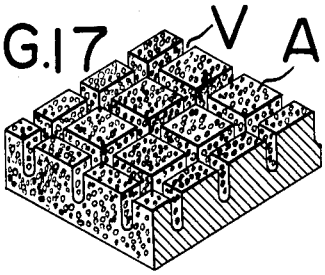
Figure 18:
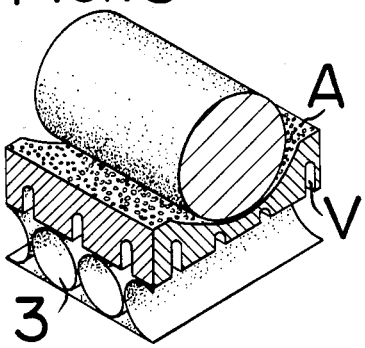

In FIGS. 17 and 18, the air-containing elastic layer A is provided with the channels V arranged in a grid-like manner. In this case, some channels V are provided parallel with the tubular air bags 3 and others are perpendicular to the tubular air bags 3. With this structure, the air-containing elastic layer A can compress independently a part of the tubular air bag 3 and when the air-containing elastic layer A does not compress the whole of one tubular air bag 3 it can smoothly compress at least a part of the tubular air bags as shown in FIGS. 5 and 6.

Figure 20:
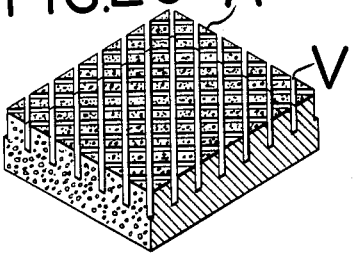
Figure 21:
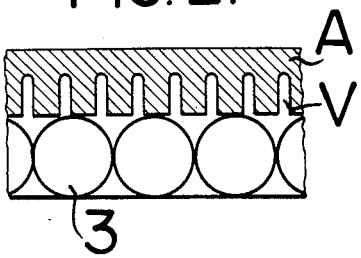
Figure 19:
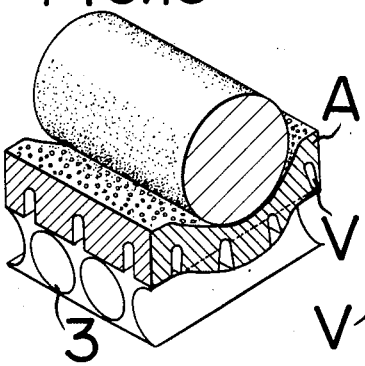
Figure 22:
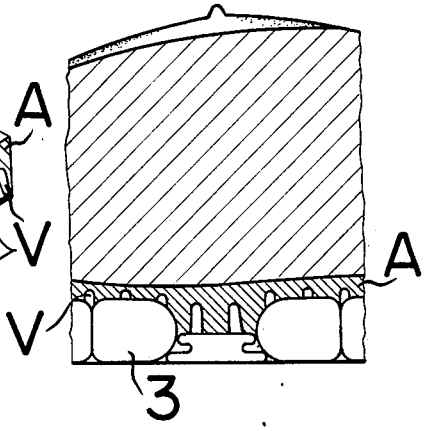

Further, the air-containing elastic layer A shown in FIGS. 20 to 22 are provided with channels V in a grid-like arrangement with a smaller pitch in comparison with the diameter of the tubular air bag 3. The channels V are oriented to be oblique with respect to the length of the tubular air bag 3. This air-containing elastic layer A can also compress independently a part of tubular air bag 3 and it has the same advantage as that of the air-containing elastic layer A shown in FIGS. 17 to 19.

Figure 23:
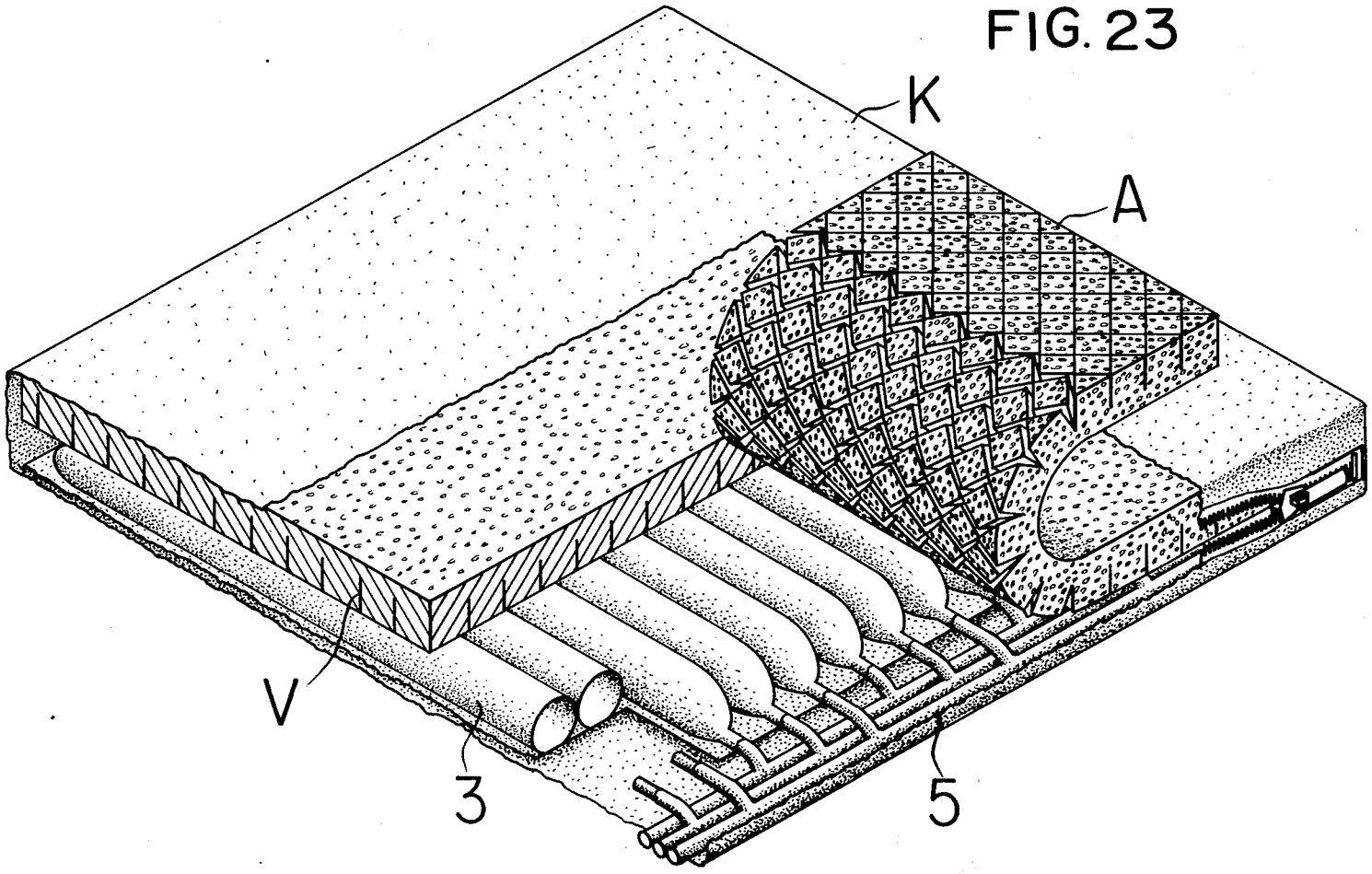
FIG. 23 a partly sectioned perspective view of an example of the mat body.

In FIG. 23 the air-containing elastic layer A provided with channels V in the lower face thereof is mounted on the tubular air bags 3. The air-containing elastic layer A is covered with a cover K formed of air-permeable cloth on the like and removably on the tubular air bags 3.

The side portion of the cover K can be opened by means of a fastener on the like. The air-containing elastic layer A is put in and out of the cover K through this openable side portion.

Figure 24:
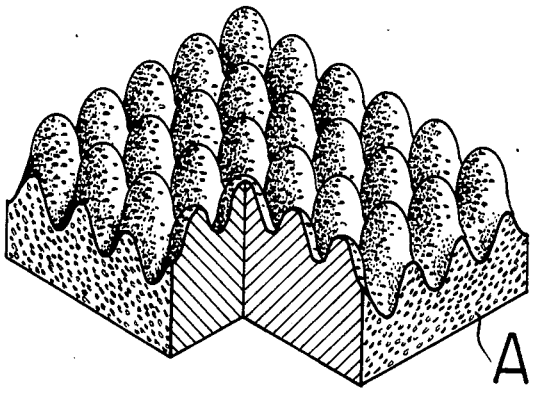
FIGS. 24 and 25 are perspective views of an example of the air-containing elastic layer.
Figure 25:
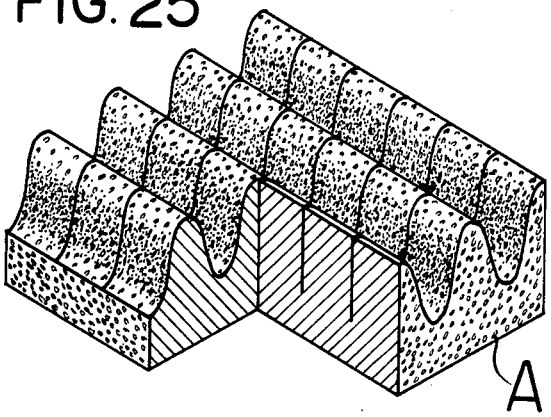

The air-containing elastic layer A may have a raised and recessed lower face which compresses the tubular air bag 3 as shown in FIGS. 24 and 25. A part of the air-containing elastic layer A having such a shape can also independently compress the tubular air bag 3 and strongly deflate a part of the tubular air bags 3 to thereby increase the ventilation volume.

Though not shown, all dimensions of the air-containing elastic layer A can be selected to be much larger than those of the mat body. Further, if the air-containing elastic layer A can be separated from the tubular air bags 3 or if the cover K for holding the air-containing elastic layer A on the tubular air bags 3 can be separated from the tubular air bags 3, advantageously the air-containing elastic layer A and the cover K are washable.

As the air source, an air pressure pump 6 of 50 to 300 mmHg discharge pressure or a combination of a reduction valve 7 and a pressurized air tank 8 as shown in chain line in FIG. 1 is used. When the air pressure tank 8 is used, high pressure air in the tank 8 is reduced to 50 to 300 mmHg by means of the reduction valve 7 and then fed into the tubular air bags 3.

When the tubular air bags 3 are opened to the atmosphere by means of the changeover valve 2, the compressed portion of the tubular air bags 3 is deflated, but air may be discharged out of the tubular air bags 3 by means of the changeover valve 2 so that the tubular air bags 3 are forcibly deflated. In order to realize this feature, the air discharge pump 9 and the air source are connected to the changeover valve 2.

Figure 26:
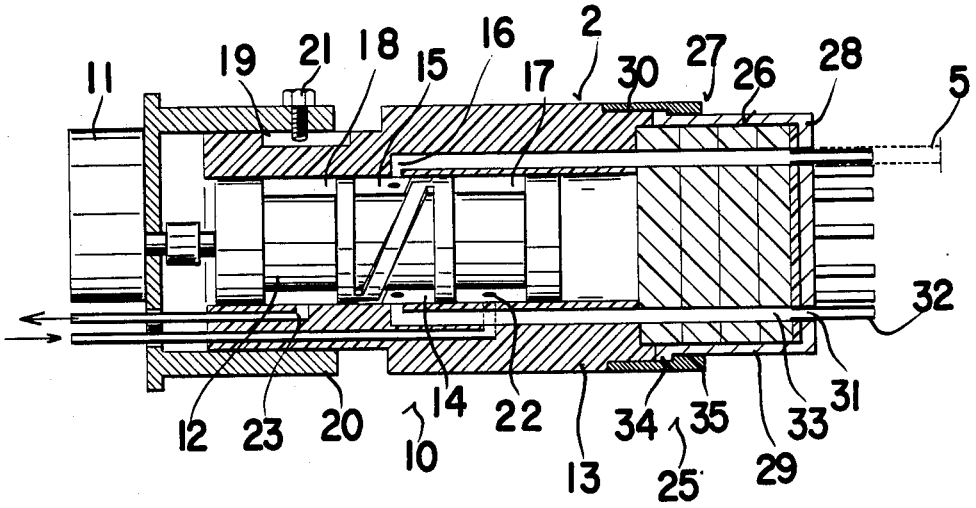
FIG. 26 is a sectional view of the changeover valve.

The changeover valve 2 shown in FIGS. 26 to 28 comprises a valve body 10 and a drive motor 11 for driving the valve body 10. The valve body 10 comprises a changeover element 12 adapted to be rotated by the drive motor 11 and a casing 13 into which the changeover element 12 is rotatably inserted.

The whole shape of the changeover element 12 is circular-cylindrical. An air inlet recess 14 and an air outlet recess 15 are provided in the outer circumferential surface of the changeover element 12. The air inlet recess 14 and air outlet recess 15 are provided adjacent to each other in the direction of the rotation of the changeover element 12 so that, through the rotation of the changeover element 12, an air opening 16 provided in the casing 13 can be alternately communicated with either the air inlet 14 or the outlet recess 14, 15.

In the valve body 10 shown in FIGS. 26 and 28, the inflating and deflating motion of the tubular air bags can be changed by displacing the casing 13 in the axial direction with respect to the changeover element 12. That is, the number of the tubular air bags 3 to be inflated as a group can be changed.

Figure 33:
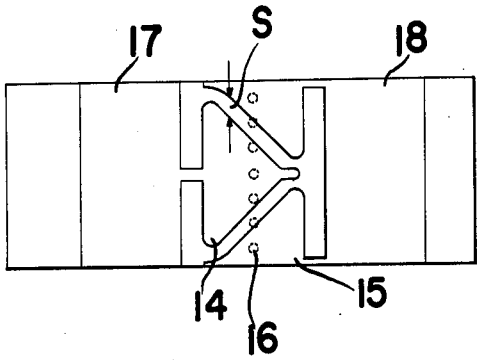
FIG. 33 is a plan view of the changeover piece.
Figure 34:
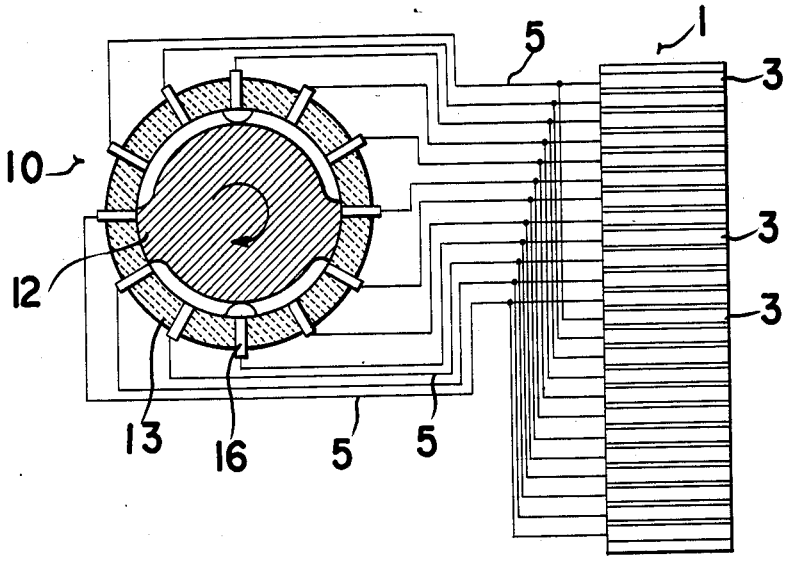
FIG. 34 is a schematic plan view showing the connection of the changeover valve and the mat body.

FIG. 33 is a plan view showing the air inlet recess 14 and air outlet recess 15. The air inlet recess 14 is so formed that it becomes narrower in the axial direction and has a tapered end. The air outlet recess 15 is provided adjacent to the air inlet recess 14 and circumferentially spaced from the latter by a given distance S. The width of the air outlet recess 15 changes in the axial direction.

The air inlet 14 and outlet recess 15 are separately communicated with introduction recesses 17, 18 so that the air inlet recess 14 is always communicated with the air source and the air outlet recess 15 is communicated with the air discharge pump 9. As shown in FIG. 26, introduction recesses 17, 18 are provided on either side of the air inlet 14 and outlet recesses 15 and throughout the outer circumference of the changeover element 12.

One end of the changeover element 12 is connected to the drive motor 11 so that the changeover time can be controlled by changing the rotation number of the drive motor 11.

Figure 30:
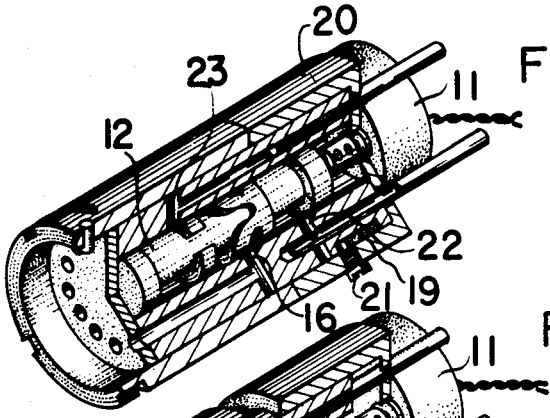
FIGS. 30 and 31 are partly sectioned perspective views of the movable cylinder in the operating state.
Figure 31:
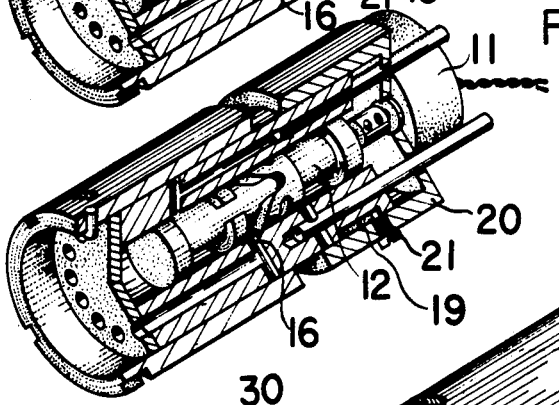
Figure 32:
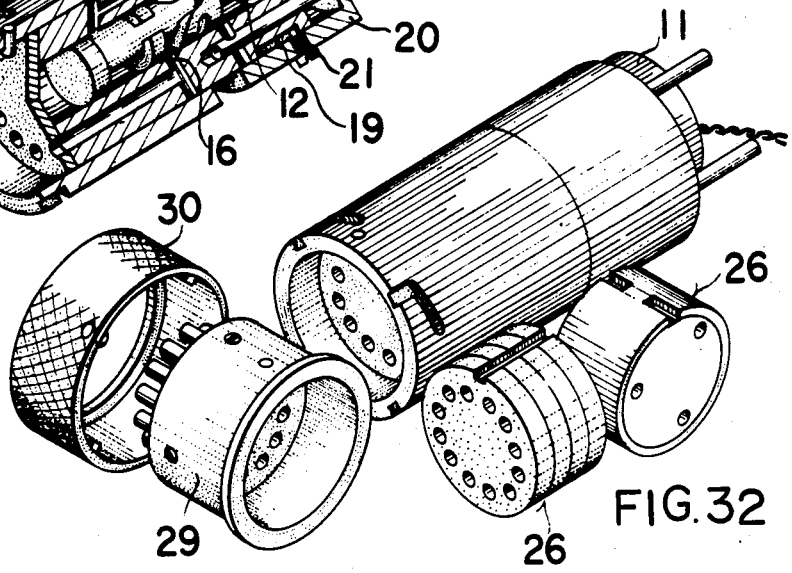
FIG. 32 is a perspective view of the control member in the disassembled state.

The casing 13 is formed of a cylinder into which the changeover element 12 can be airtightly and rotatably inserted. The head and rear ends of the casing 13 are opened and the changeover element 12 is inserted in and pulled out through the opened rear end. As shown in FIGS. 28, 30 and 31, on the outer circumferential surface of the rear end of the casing 13, a movable cylinder 20 is mounted so as to be movable in the axial direction. To the movable cylinder 20, the drive motor 11 is fixed. An axially elongated key way 19 is provided in the rear portion of the outer circumferential surface of the casing 13. The head portion of a setscrew 21 penetrated into and fixed to the movable cylinder 20 is slidably guided into the key way 19. With the sliding movement of the movable cylinder 20 with respect to the casing 13, the casing 13 and the changeover element 12 are moved with respect to each other.

As shown in FIGS. 26 and 33, the air openings 16 are provided in correspondence with the locus of the displacement of the air inlet recess 14 and the air outlet recess 15 in the surface of the changeover element 12. An air inlet opening 22 is opened in correspondence with the introduction recess 17 communicated with the air inlet recess 14 while an air outlet opening 23 is opened in correspondence with the introduction recess 18 communicated with the air outlet recess 15.

When the changeover element 12 is displaced with respect to casing 13, the positions where the air openings 16 pass the air inlet recess 14 and the air outlet recess 15 change, and the condition how each air opening 16 is communicated with the air inlet recess 14 or the air outlet recess 15 also changes.

Figure 35:
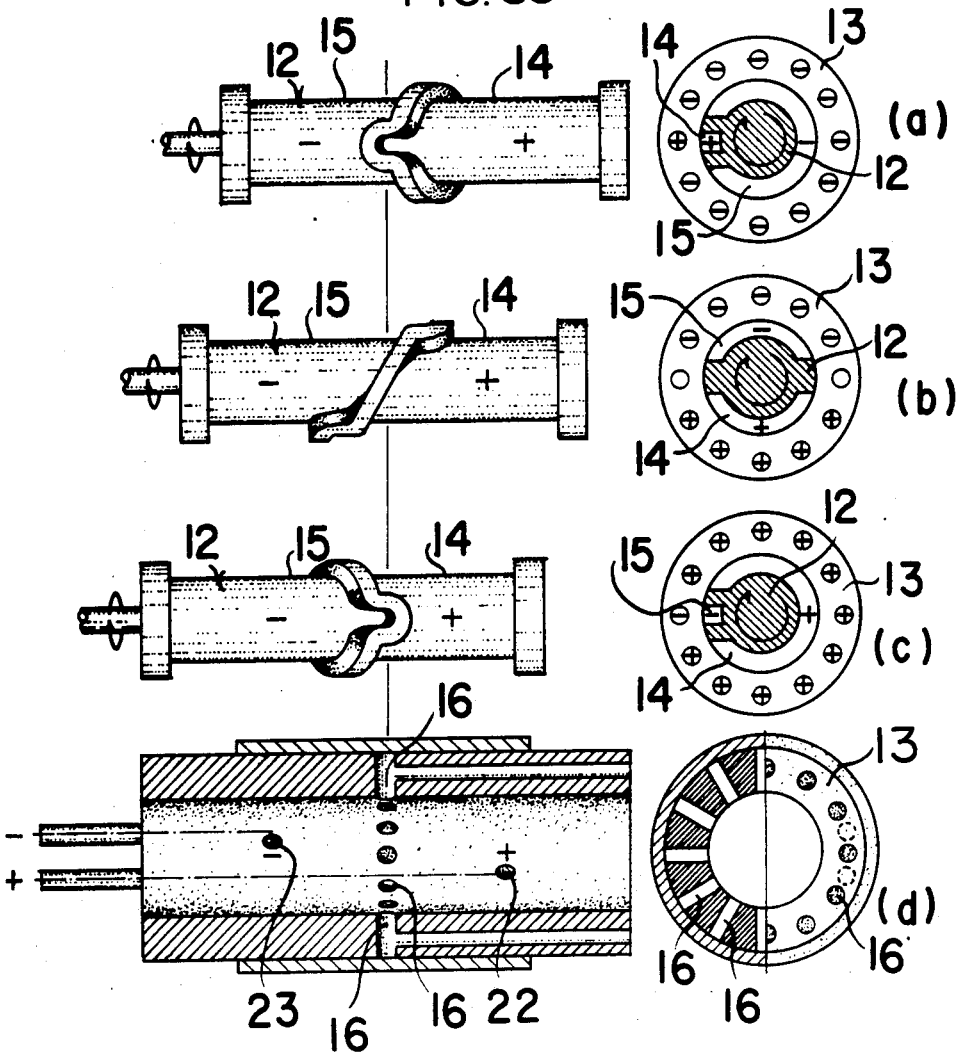
FIGS. 35 (a) through (d) side and sectional views of the changeover element and the casing, the relative positions of which are variously changed.
Figure 36:
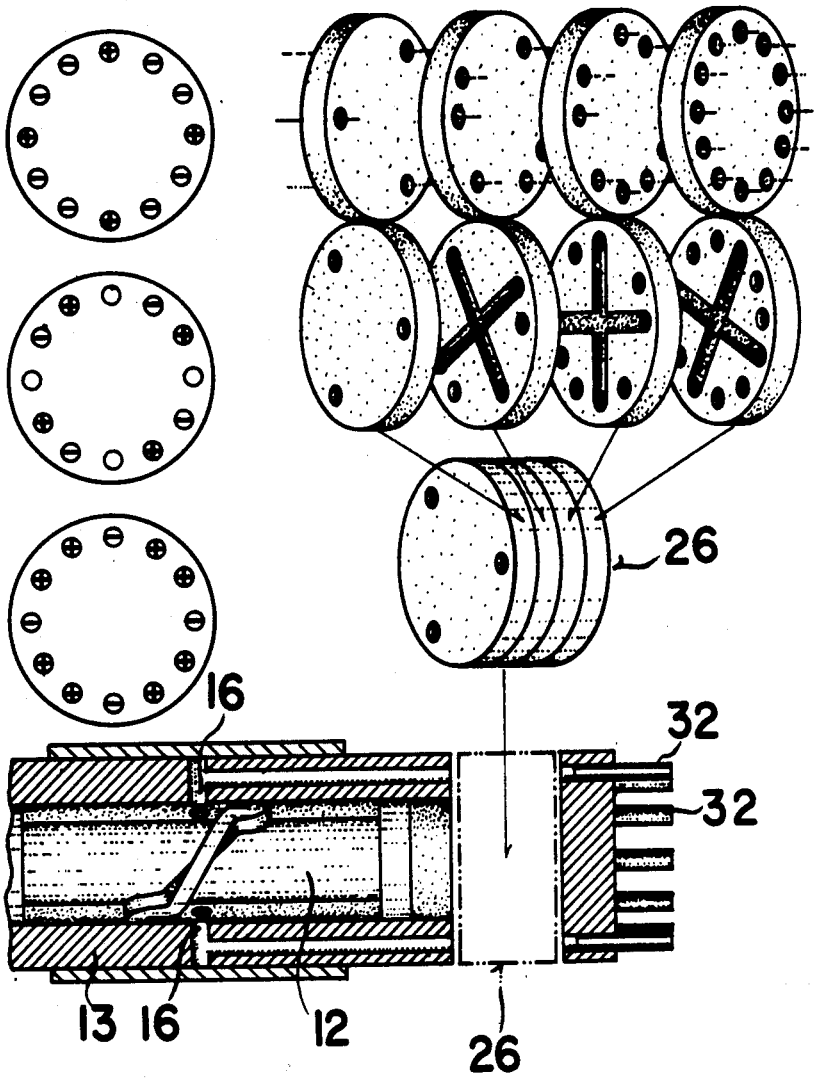
FIG. 36 is a sectional view of the casing of the changeover valve and a cross-sectional view of the assembled cassette.

With the displacement of the changeover element 12 to the right as shown in FIG. 35(*a*), the number of the air openings 16 communicated with the air inlet recess 14 is decreased, and thereby the number of the tubular air bags in the inflated state is decreased.

When the changeover element 12 is displaced to the rightmost position, a single air opening 16 is communicated with the air inlet recess 14. On the contrary when the changeover element 12 is displaced to the left as shown in FIG. 35(*c*), a number of air openings 16 are communicated with the air inlet recess 14 and a number of the tubular air bags 3 are inflated. Further, when the changeover element 12 is located in the middle position as shown in FIG. 35(*b*), half the number of the air openings 16 are communicated with the air inlet recess 14 and the remaining half communicated with the air outlet recess 15. Thus, the tubular air bags 3 in the inflated state and the tubular air bags 3 in the deflated state become equal in number.

In the changeover element 12 shown in FIG. 35, a partition between the introduction recesses 17, 18, the air inlet 14 and outlet recess 15 is removed.

In the changeover valve shown in FIGS. 30 and 31, with the displacement of the movable sleeve 20 in the axial direction, the novable cylinder 20 and the changeover element 12 are displaced with respect to each other. However, the same result can be obtained by displacing the casing in the axial direction with respect to the changeover element 12 while keeping the movable sleeve 20 fixed. In this case, though not shown, casing is fitted to a base so as to be movable in the axial direction.

The air inlet opening 22 is connected through a hose to the air source while the air outlet opening 23 is connected through a hose to the air discharge pump 9.

If the air openings 16 and the tubular air bags 3 are equal in number, one tubular air bag 3 is connected to one air opening 16. If the number of the tubular air bags 3 is larger than that of the air openings 16, a plurality of tubular air bags 3 are connected to one air opening 16.

The control means 25 is positioned in the output side of the changeover valve 2 i.e. interposed between the air opening 16 of the changeover valve 2 and the hose 5, as shown in FIG. 26. The control means 25 comprises a cassette 26 and a case 27 into which the cassette 26 is contained.

Figure 37:
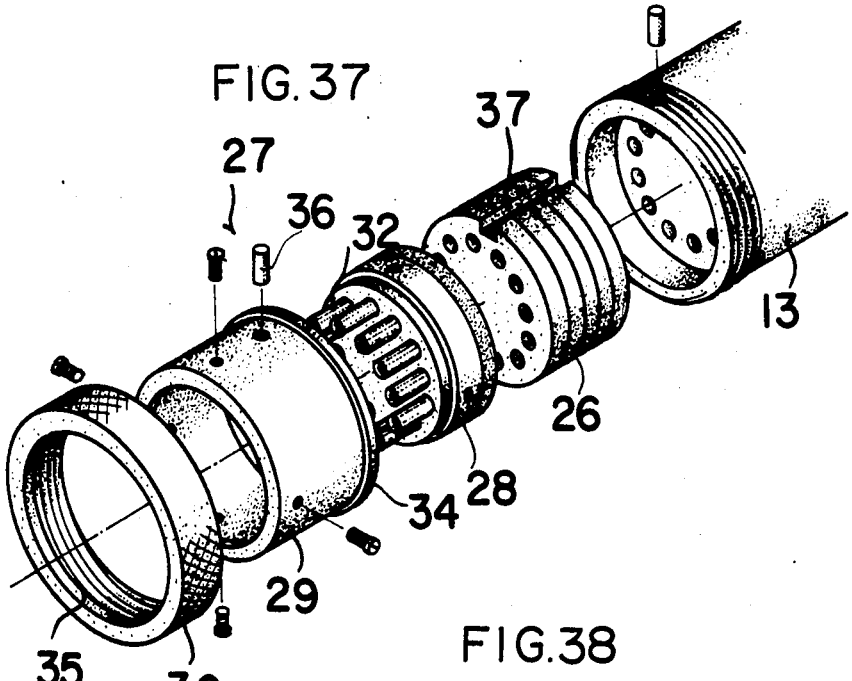
FIGS. 37 and 38 are exploded perspective and sectional views of the control member.
Figure 38:
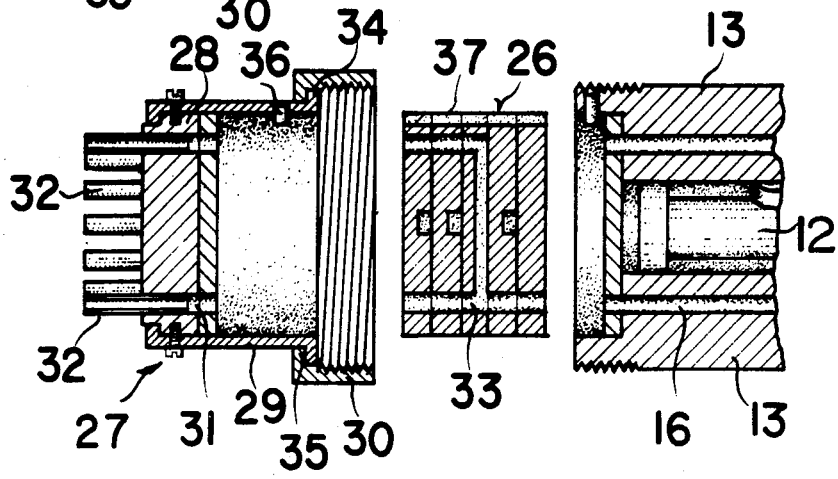

By integrating the control means 25 with the changeover valve 2 as shown in FIGS. 37 and 38, the functions of the two can be simplified. However, though not shown, it is possible to form the control means 25 and the changeover valve 2 as two separate members and to connect the output side of the control means 25 through the hose 5 with the changeover valve 2.

As shown in FIG. 26, the case 27 comprises a lid member 28 which is in airtight contact with the output end face of the cassette 26, fixed sleeve 29 fixed on the outer circumferential surface of the lid member 28, and a ring 30 fastening the fixed sleeve 29 to the head end of the casing 13.

The lid member 28 is formed in a disk-like shape and is provided near its outer circumference with twelve axially penetrating output openings 31 to which a pipe 32 for connecting the hose 5 is fixed. The inner surface of the lid member 28 is in close contact with the surface of the cassette 26 and communicated with the output side of connection openings 33 penetrating the cassette 26.

At one end of the fixed sleeve 29, a flange 34 is extruded, as shown in FIG. 38, the flange 34 is engaged with the ring 30 and brought in close contact with the end face of the casing 13.

As shown in FIGS. 37 and 38, the inside of the ring 30 is internally threaded and at one end of the ring 30 a collar 35 is provided.

A positioning pin 36 is extruded from the inner surface of the fixed sleeve 29. An axially elongated groove 37 into which the positioning pin 36 is guided is provided in the outer circumferential surface of the cassette 26. When the cassette 26 contained by the positioning pin 36 is guided in the groove 37, the output openings 31 of the lid member 28 are positioned in correspondence with the connection openings 33 of the cassette 26 and communicated with the connection openings 33.

The cassette 26 is in the shape of a cylinder the outer diameter of which is so selected that the cassette 26 can be removably contained in the fixed sleeve 29 and the casing 13. The cassette 26 is provided with the axially penetrating connection openings 33.

By changing the shape of the connection openings 33 provided in the cassette 26, the inflation and deflation conditions of the tubular air bags 3 can be controlled.

Figure 39:
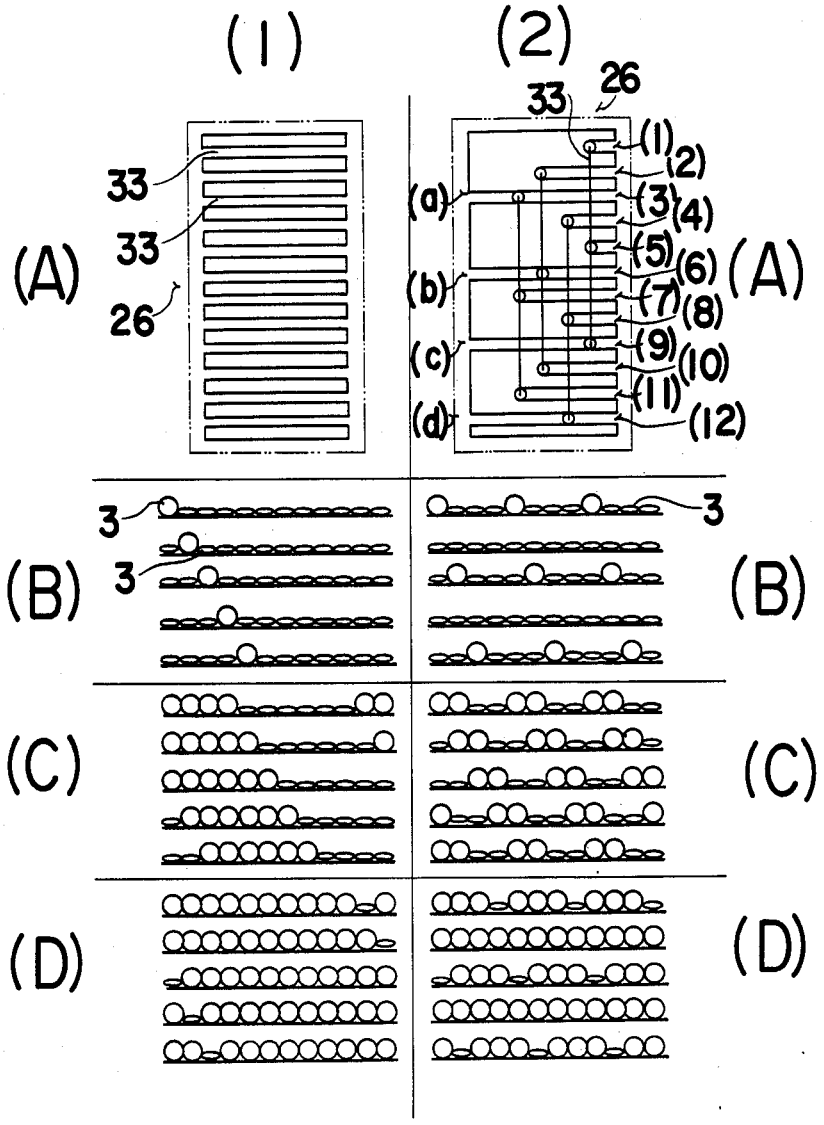
FIGS. 39 (1)(A) through (5)(D) connecting diagrams showing the connection of the connection openings of the cassettes, sectional views showing the inflation and deflation of the air cylinder and sectional views of the changeover valve.
Figure 39:
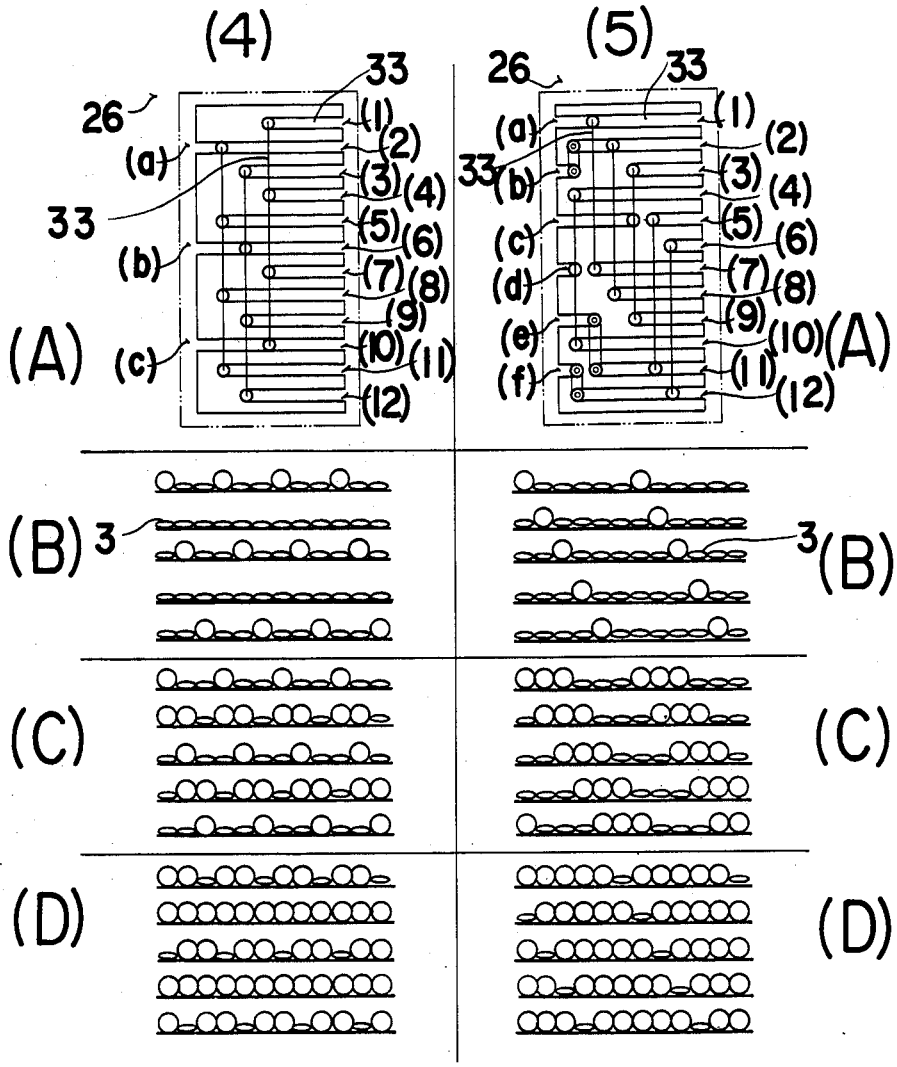

In FIG. 39, the communication of the connection openings 33 of the cassette 26 is shown. In (A) of FIG. 39 (1)(2)(4)(5), the left side of the cassette 26 is in the input side which is communicated with the air opening of the changeover valve 2 and the right side is the output side of the pipe 32 of the output opening of the lid member 28.

In the cassette 26 shown in FIG. 39 (1)(A), twelve connection openings 33 are axially elongated and penetrating the cassette 26 with a given pitch near the outer circumference. These connection openings 33 are independent respectively and not crossed with one another.

When the cassette 26 of such a shape is used, the tubular air bags 3 are inflated and deflated as shown in (B)(C)(D) of FIG. 39 (1).

The relative positions of the changeover element 12 and the casing 13 in the conditions shown in (B)(C) and (D) of FIG. 39 (1) is shown in FIG. 39 (3). In FIG. 39 (3), (B) shows that the changeover element 12 is located in the right side and many of the air openings 16 are communicated with the air outlet opening 23; (D) shows that the changeover element 12 is located in the left side and many of the air openings 16 are communicated with the air inlet opening 22; and (C) shows that the changeover element is in the middle position and the air openings 16 are communicated with half of the air inlet opening 22 and the air outlet opening 23 respectively.

In FIG. 39 (1), the ratio of the number of the air openings 16 communicated with the air inlet opening is raised toward (D), so that the number of the tubular air bags 3 in the inflated stated is increased. The inflated or deflated tubular air bags 3 are moved from the left to the right with the rotation of the changeover element 12.

In the connection openings 33 of the cassette 26 shown in FIG. 39 (2)(A), each of four openings (a)(b)(c) and (d) opened on the input side is branched into three openings which are communicated with twelve openings on the output side. The opening (a) on the input side is communicated with the openings (3)(7) and (11), the opening (b) communicated with openings (1)(5) and (9), and the opening (d) communicated with openings (4)(8) and (12).

The inflation and deflation of the tubular air bags 3 is shown in FIG. 39 (2)(B)(C)(D) when the above cassette 26 is used. In other words, the whole of the tubular air bags 3 is divided into the three blocks and every third tubular air bag 3 is simultaneously inflated and deflated, so that the wave motion whose wavelength is four is transmitted from the left to the right.

Further, in the connection opening 33 of the cassette 26 shown in FIG. 39 (5)(A), each of six openings (a)(b)(c)(d)(e) and (f) on the input side is branched into two openings which are communicated with twelve openings on the output side. The opening (a) on the input side is communicated with the openings (1) and (7) on the output side, the opening (b) on the input side with the openings (2) and (8) on the output side, the opening (c) on the input side with the openings (3) and (9) on the output side, the opening (d) on the input side with the openings (4) and (10) on the output side, the opening (e) on the input side with the openings (5) and (11) on the output side, and the opening (f) on the input side with the openings 6 and 12 on the output side, respectively.

When this cassette 26 is used and the changeover element 12 is rotated, the tubular air bags 3 are inflated and deflated as shown in FIG. 39 (5)(B)(C)(D). In other words, the whole of the twelve tubular air bags 3 is divided into two blocks, and every sixth tubular air bag 3 is simultaneously inflated and deflated, so that the wave motion whose wavelength is 2 is transmitted from the left to the right.

Figure 40:
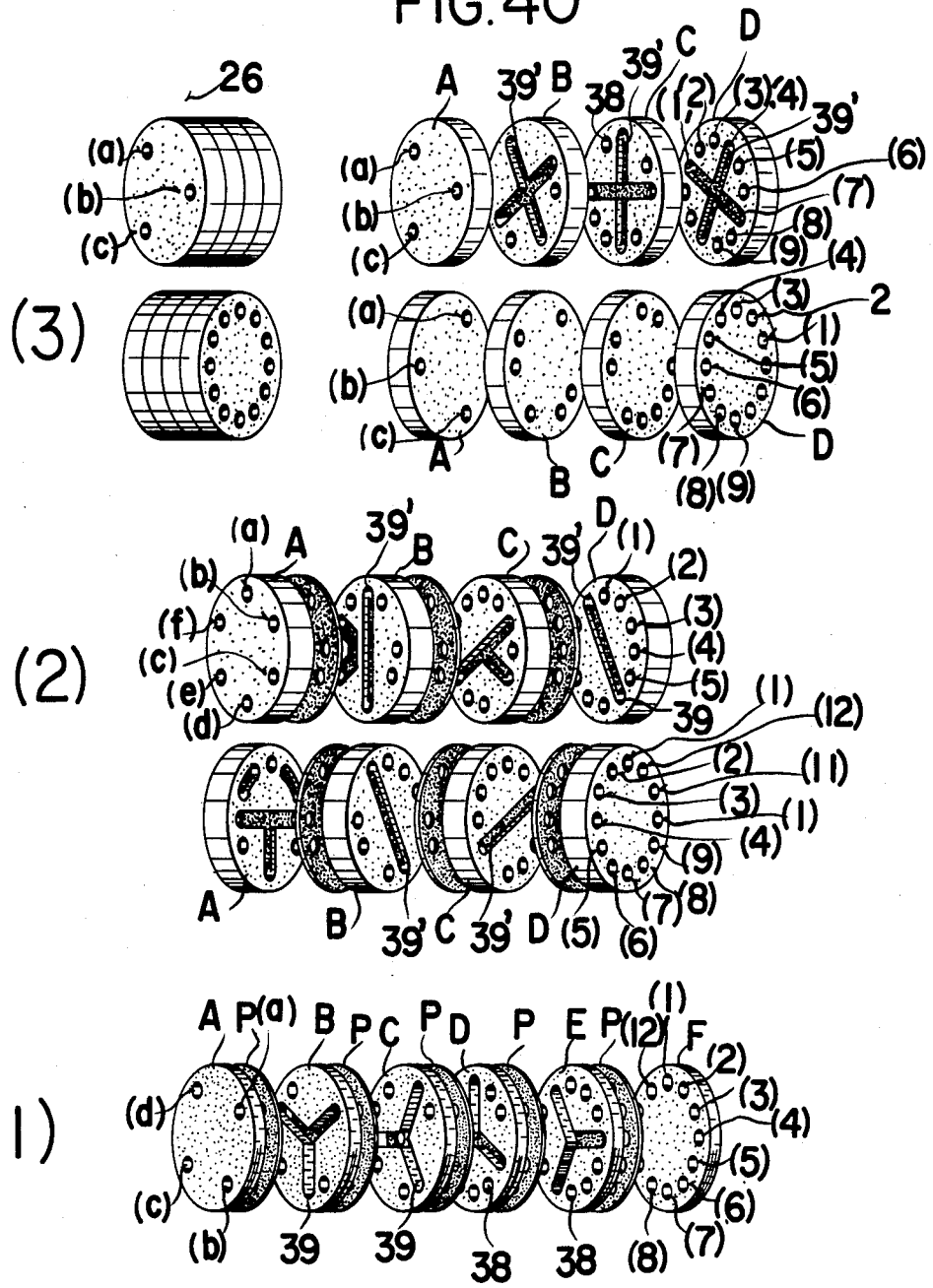
FIGS. 40 to 42 are exploded perspective views of the cassettes.

FIG. 40 is an exploded view of the cassette 26 provided with the connection openings 33 shown in FIG. 39 (A)(2)(3)(4).

In the cassette 26, plate members shown in FIG. 40 are laminated and sticked together so as not to close up the connection openings 33.

The cassette 26 shown in FIG. 40 (1) defines connection openings 33 shown in FIG. 39 (A)(2) and comprises six thick plate members A,B,C,D,E,F and five thin plate members P. Each thick plate member is provided with through openings 38 in the portion near the outer periphery and with a radially extended branched window 39.

Figure 43:
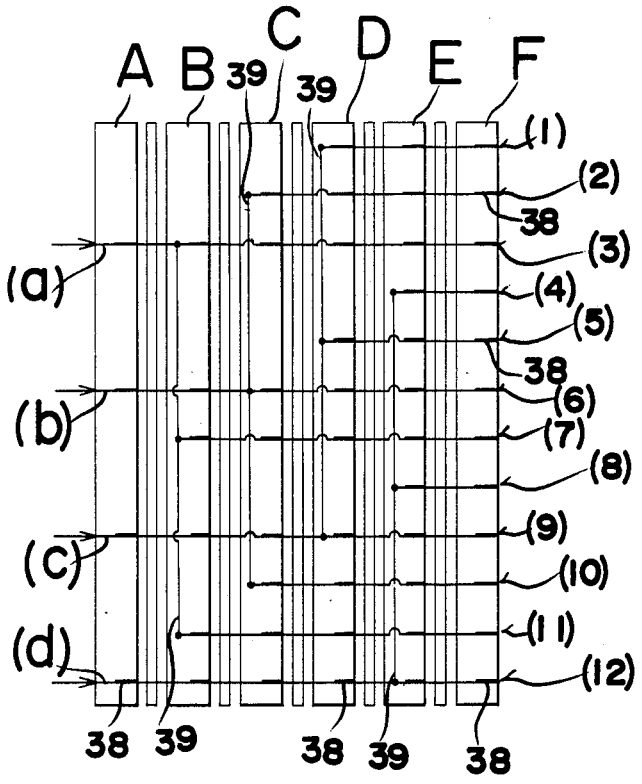
FIG. 43 is a connecting diagram of the connection openings of the cassettes shown in FIG. 40(1)

The shapes of the through openings 38 and the branched window 39 are shown in FIGS. 40 and 43. The thick plate members B,C,D,E are provided with the branched window 39 whose branches are radially extended respectively with an angle of 120 degrees therebetween. In each of the thick plate members B,C,D,E, the radially extended branched window 39 is provided at the position shifted with a radial pitch of 30 degrees from the left toward the right plate member.

In FIG. 43, the connection opening communicated with the opening (a) on the input side is passing through the thick plate member A and communicated through the branched window 39 in the thick plate member B with the openings (3)(7)(11) on the output side. Similarly, the opening (b) on the input side is passing through the thick plate members A,B and branched into three in the thick plate member C and communicated with the openings (2)(6)(10) on the output side. The opening (c) on the input side is passing through the thick plate members A,B,C and branchedinto three in the thick plate member D and communicated with the openings (1)(5)(9) on the output side. Further, the opening (d) on the input side is passing through the thick plate members A,B,C,D and branched into three in the thick plate member E and communicated with the openings (4)(8)(12) on the output side.

In FIG. 40, the thin plate member P interposed between the thick plate members closes up the opening of the branched window 39 without closing up the through openings 38.

FIG. 40 (2) is an exploded perspective view of the cassette 26 in which there are openings on the input side. The upper row is a perspective view of thick plate members seen from the left and the lower row is that seen from the right.

As shown in FIG. 39 (5)(A), in the cassette 26 of FIG. 40 (2), the opening (a) on the input side is passing through the thick plate member A and branched into two through the branched groove 39' in the left side face of the thick plate member B to form the openings (1)(7) on the output side. The opening (b) on the input side is communicated in the right side face of the thick plate member A with the opening (2) on the output side and passing through the thick plate member B and branched into two through the branched groove 39' in the right side surface of the thick plate member B to form the opening (8) on the output side. The opening (c) on the input side is passing through the thick plate members A,B and branched on the right side face into two openings (3)(9) on the output side. The opening (d) on the input side is communicated on the right side face of the thick plate member A with the openings (4)(10) on the output side. The opening (e) on the input side is communicated on the left side face of the thick plate member B with the opening (11) on the output side, passing through the thick plate members B,C and communicated on the right side face of the thick plate member C with the opening (5) on the output side. Further, the opening (f) on the input side is passing through the thick plate member A, communicated on its right side face with the opening (12) on the output side, passing through the thick plate members B,C and communicated on the right side face with the opening (6) on the output side.

Further, as shown in FIG. 39 (A)(4), in the cassette 26 of FIG. 40 (3), the opening (a) on the input side is passing through the thick plate member A, communicated on the left side face of the thick plate member B with the openings (2)(5)(8)(11). Similarly, the opening (b) on the input side is passing through the thick plate members A,B and communicated on the left side face of the thick plate member C with the openings (3)(6)(9)(12) on the output side. Further, the opening (c) on the input side is passing through the thick plate members A,B,C and communicated on the left side face of the thick plate member D with the openings (1)(4)(7)(10) on the output side.

In the cassette 26 shown in FIGS. 40 (2) and 3, a groove is provided in one face of the thick plate member. However, it is possible to provide a groove 40 in the circumferential surface and close up the groove with a cylinder.

FIG. 40 shows an example of the cassette 26 in which the openings on the input side are three, four or six and the openings on the output side are twelve. In this example, the openings on the input and output sides and the communication of the connection openings connecting the input and output sides together are variously changeable in accordance with the use, though all of them are not shown.

It is advantageous that the cassette 26 formed by laminating plate members and sticking them together as shown in FIG. 40 can be easily and inexpensively manufactured on a mass scale.

Figure 42:
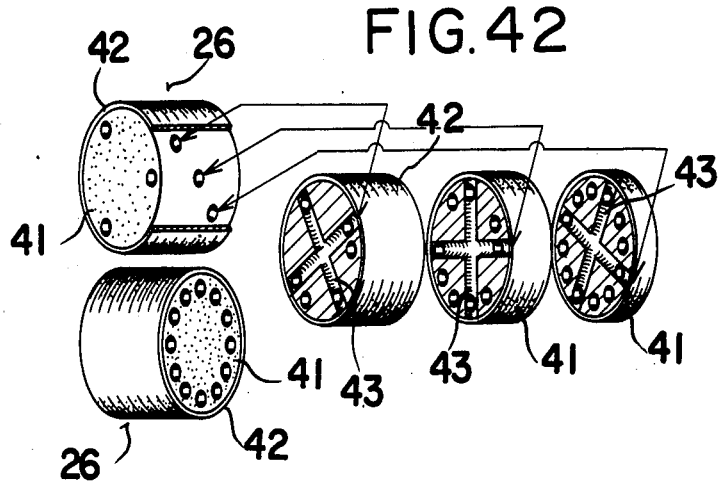

In FIG. 42, the cassette 26 comprises a column 41 and a cylinder 42 in which the column 41 is tightly inserted. As shown in the sectional views of FIG. 42 (2)(3)(4), radially elongated branched openings 43 are provided in the column 41, and by closing up the branched openings 43 in the circumferential surface by means of the cylinder 42, connection openings are formed similarly to those of the cassette 26 shown in FIG. 40.

This cassette 26 comprises rectagular, not circular, plate members 44 laminated and sticked together, and two sets of connection openings in different communication are provided in the right and left parts respectively of the plate members 44. With this cassette 26, the inflation and deflation of the tubular air bags can be controlled only by moving the cassette to the right and left, unlike the cassette 26 shown in FIG. 40 which has to be re-inserted into the case 27 for changing the state of the tubular air bags 3.

Figure 41:
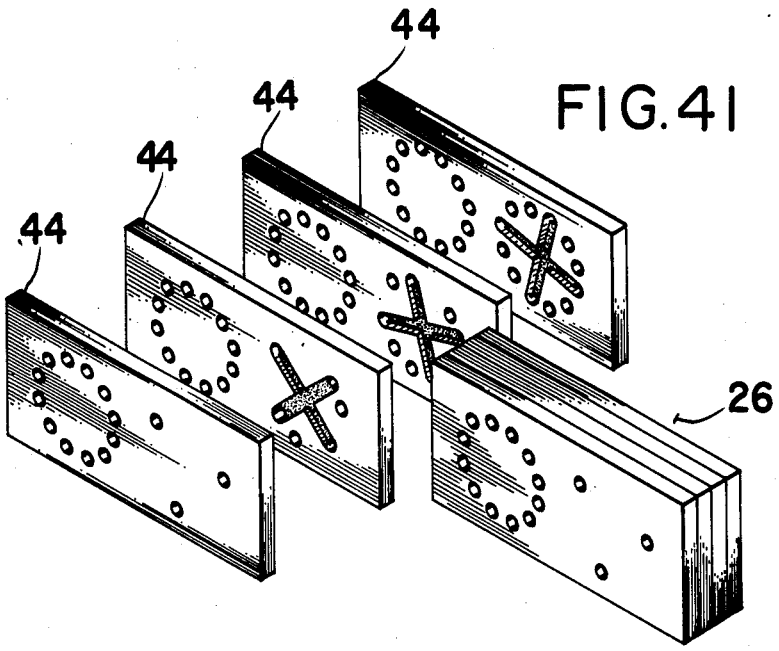
Figure 44:
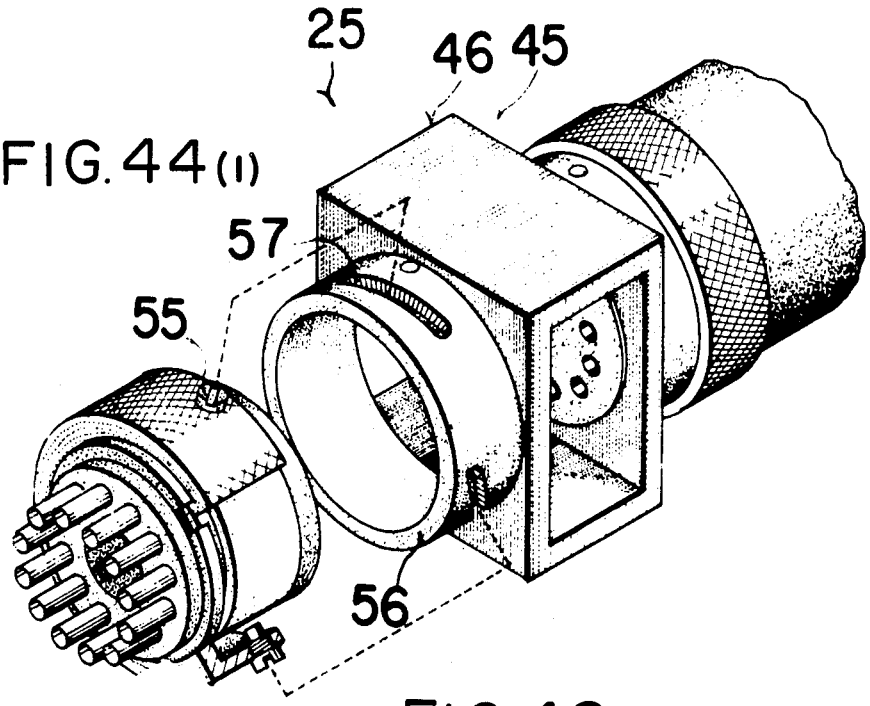
FIGS. 44(1), 44(2) and 45 are perspective views of the control means of another example.
Figure 46:
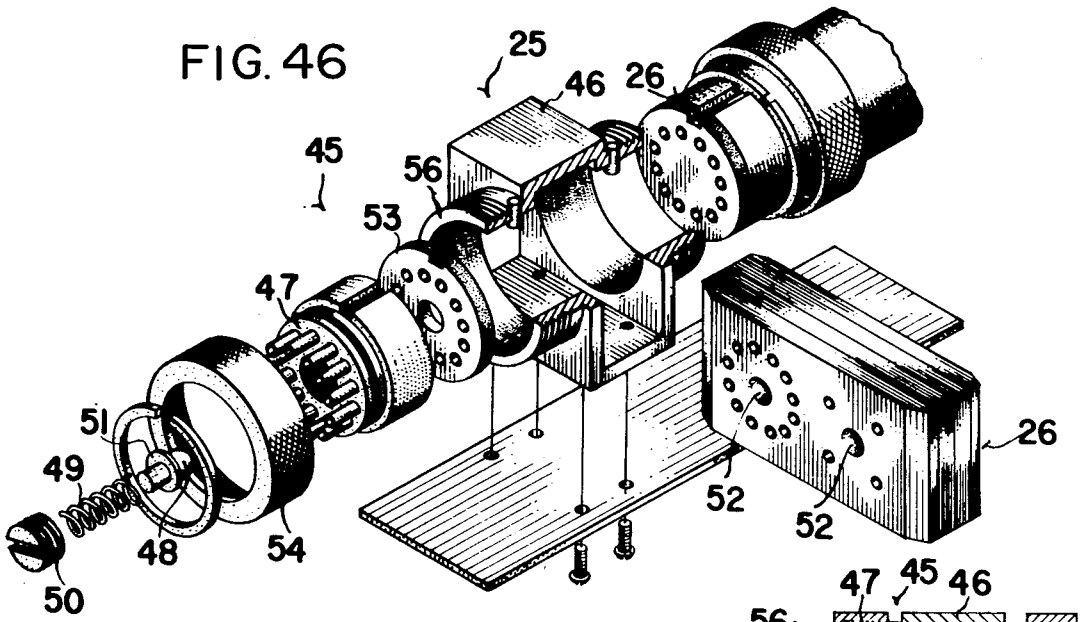
FIGS. 46 and 47 are partly sectioned perspective views of the changeover valve.
Figure 47:
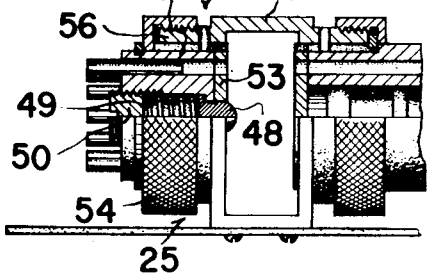

The case 45 of the control means 25 for containing the cassette 26 shown in FIG. 41 is illustrated in FIGS. 44 (1) and (2) to FIG. 47. This case 45 is provided with a slide frame 46 through which the cassette 26 can be laterally slided. As shown in FIG. 46, the right and left ends of the slide frame are opened and a resilient projection 48 for stopping the slide frame 46 is provided in the center of the lid member 47.

As shown in FIGS. 46 and 47, the resilient projection 48 is pushed by a push spring 49 which is pushed by a setscrew 50 screwed in the center of the lid member 47. The resilient projection 48 has a hemispherical head end and is provided at its rear end with a collar 51 which is engaged in the central opening of the lid member 47. When the cassette 26 is slid in the lateral direction, the resilient projection 48 is pushed in, and when the cassette 26 is slid to the predetermined position, the resilient projection 48 is pushed in the stop recess 52 in the cassette 26 whereby the sliding of the cassette 26 is stopped.

Figure 45:
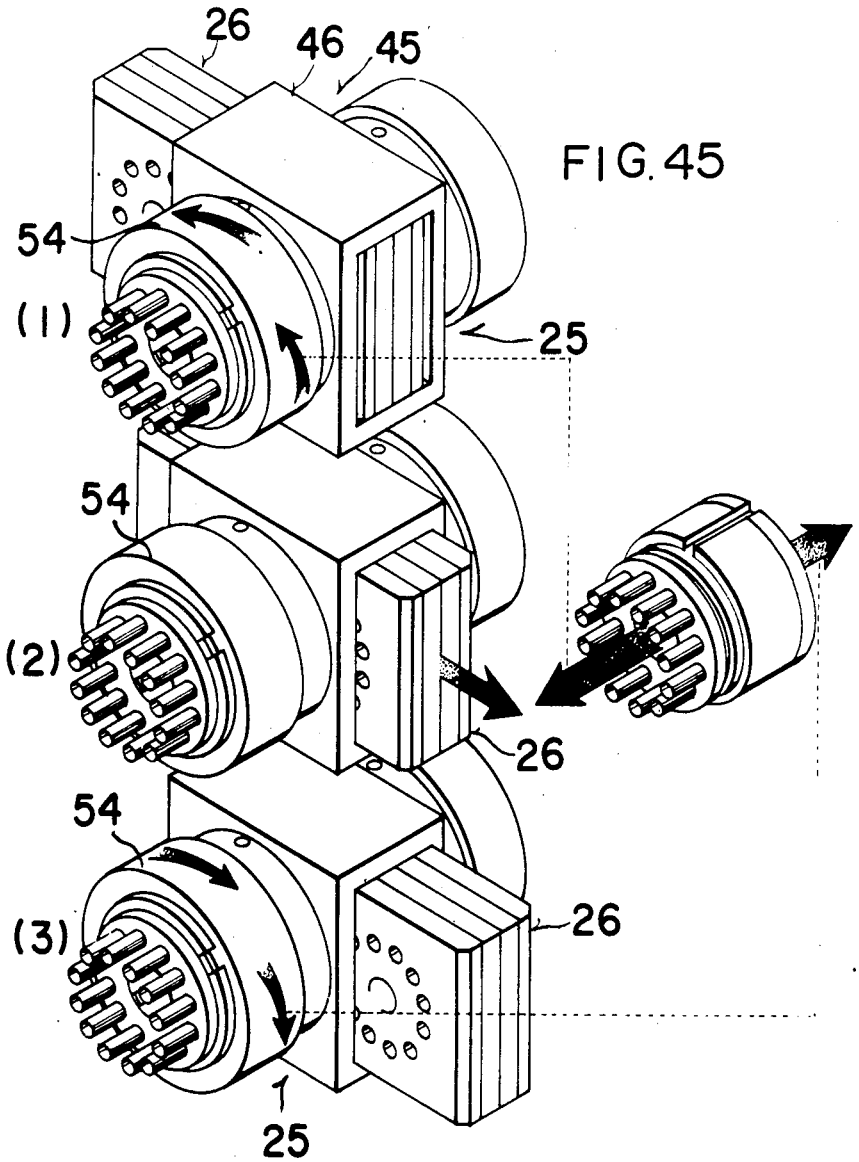

When the cassette 26 is slid in the lateral direction, a disk 53 interposed between the surface of the cassette 26 and the lid member 47 is preferably separated from the surface of the cassette 26. As shown in FIG. 45 (1)(2)(3), this separation is realized by loosening the ring 54 to separate the disk from the surface of the cassette 26 (FIG. 45 (1)), then displacing the cassette in the lateral direction to the predetermined position (FIG. 45 (2)), and then fastening the ring 54 in so as to put the disk in close contact with the surface of the cassette 26.

The disk 53 shown in FIGS. 46 and 47 is formed of rubber-like elastic material so that preferred airtightness can be obtained when the disk 53 is closely interposed between the surface of the cassette 26 the lid member 47.

In the control means 25 shown in FIGS. 44 and 45, the ring 54 is fastened through a pin to the fixed cylinder 56 of the slide frame 46. Consequently, as shown in FIG. 44, the fixed cylinder 56 is provided with a threaded groove 57 in which the pin 55 is projected.

In the control means 25 shown in FIGS. 46 and 47, the outer circumferential surface of the fixed cylinder 56 is externally threaded, and the ring 54 with an internally threaded inside surface is screwed on the fixed cylinder 54.

Figure 49:
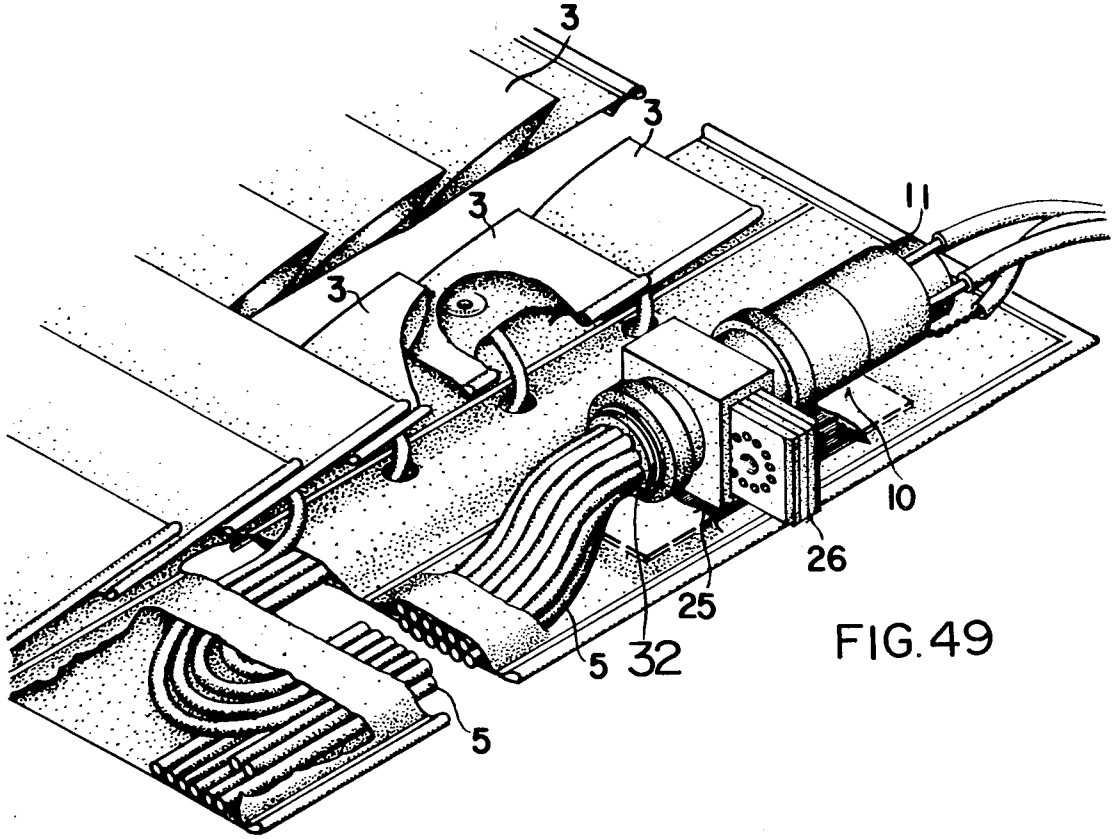
FIG. 49 is a perspective view showing the connection of the changeover valve and the mat body.

As shown in FIG. 49, in the control means 25, the pipe 32 is connected with hoses 5 which are connected to the bags 3.

Figure 48:
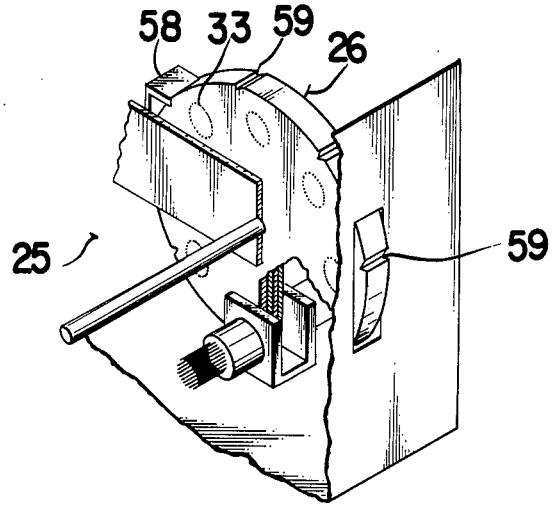
FIG. 48 is a perspective view of a further control means.

FIG. 48 shows the control means 25 having the cassette 26 of a different construction. This cassette 26 is formed in a disk-like shape as a whole, and a plurality of sets of connection openings 33 are provided near the outer periphery of the disk-like cassette 26. When the cassette 26 is rotated, the connection openings 33 are changed over and the wave motion of the tubular air bags 3 is controlled. The cassette 26 is provided with a stopper 58 which is resiliently pushed into stop grooves 59 provided in the outer circumferential surface of the cassette 26.

The cassette 26 is carried at its center by means of a shaft so that it is rotatable in a vertical plane.

The disk-like cassette 26 preferably has the same mechanism as that of the control means 25 shown in FIG. 47 and preferably a disk comprising a rubber-like elastic member is put in close contact with the surface of the cassette 26, so that the cassette 26 can be smoothly rotated and air leakage can be prevented when the cassette 26 is stopped.

FIG. 49 shows the connection of the pipe 32 through the hoses 5 with the tubular air bags 3.

The mat apparatus in which a control member is connected between the changeover valve and the mat body so that the inflation and deflation of the tubular air bags are changed-over by means of the changeover valve and further the tubular air bags in the inflated or deflated conditions are changed-over by means of the control valve has advantages in that sometime the air mat can be wholly waved at a large wavelength and at another time it can be waved at a wavelength as small as 2 to 6 in accordance with the condition of the user so that the user can enjoy most effective and comfortable stimulation, and that the stimulation can be easily changed.

Figure 50:
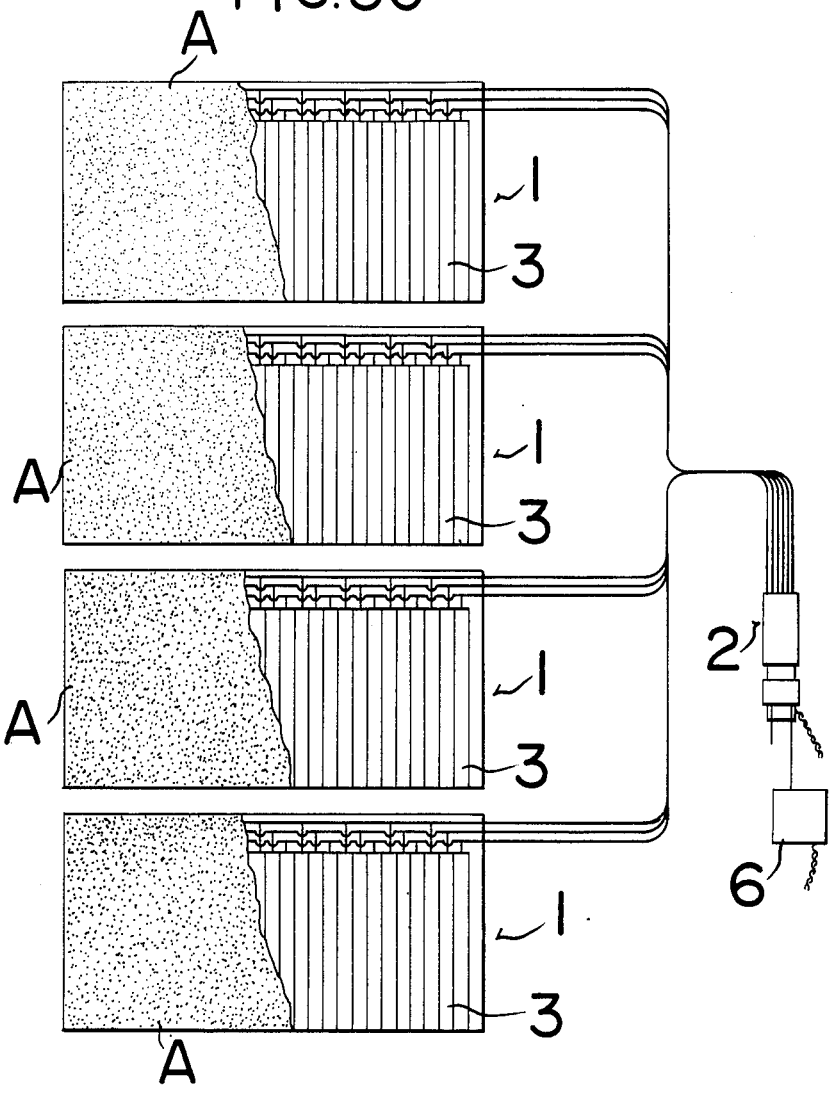
FIG. 50 is a schematic connecting diagram showing the connection of the air cylinder and the changeover element.

FIG. 50 also shows the connection side where four sets of mat bodies are controlled by a changeover valve 2 and an air source. If a plurality of sets of mat bodies can be driven by a changeover valve 2 and an air source, the cost required per set of mat bodies can be lowered.

When a plurality of sets of mat bodies are inflated by a changeover valve 2 and an air source as shown in FIG. 50, it is especially effective to let the tubular air bags 3 open to the atmosphere. The tubular air bags 3 are deflated by the human body so as to partly ventilate the air and decrease the air consumption.

Figures 51, 52, 53:
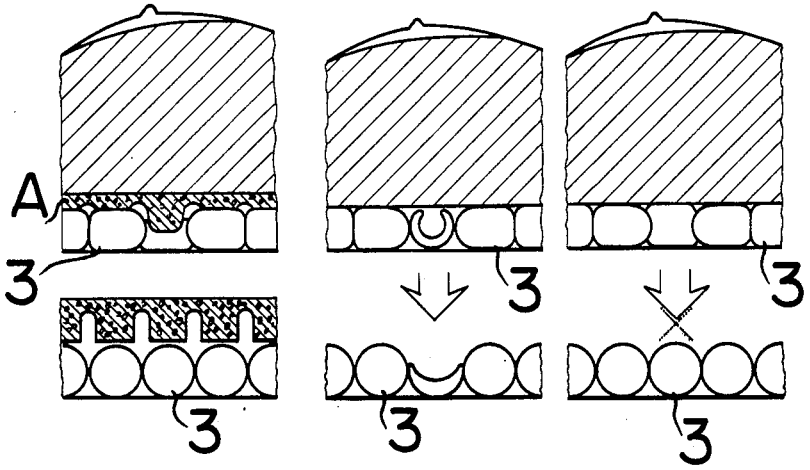
FIGS. 51 and 52 are sectional views of the conventional mat body.
FIG. 53 is a partly sectioned view of the mat body according to the present invention.
Figure 54:
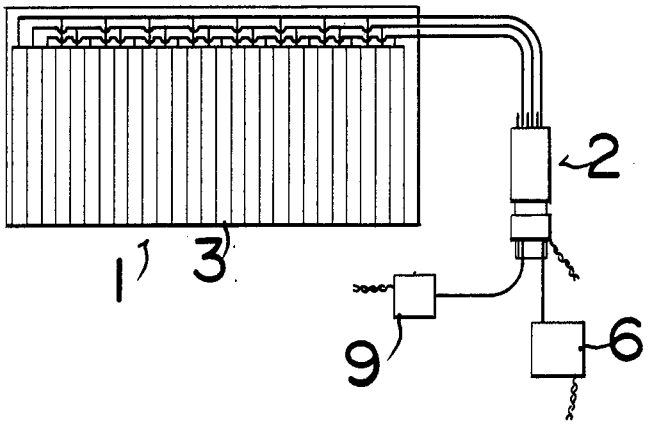
FIG. 54 is a plan view showing an example of the connection of the air cylinder and the changeover element.

In the conventional air mat apparatus in which no air-containing elastic layer is laid on the tubular air bags 3 as shown in FIG. 51, the tubular air bags 3 can be deflated only by letting the tubular air bags 3 open to the atmosphere. If air is compulsorily discharged out of the tubular air bags 3 by means of an air exhaust pump 9 as shown in full line in FIG. 54, the tubular air bags 3 are perfectly deflated as shown in FIG. 52. In this case, however, the whole amount of air in the tubular air bags 3 is discharged out and air consumption is decreased as mentioned before.

If the air-containing elastic layer A is laid on the tubular air bags 3, the tubular air bags 3 open to the outer air discharge air out when compressed by the air-containing elastic layer and are deflated as shown in FIG. 53. In this case, only a small amount of air is consumed, and the air exhaust pump being unnecessary, the whole construction of the apparatus can be extremely simplified.

In an air mat apparatus in which an air-containing elastic layer is laid on the mat body, the air-containing elastic layer has such elasticity as to change its thickness when compressed, and has numerous voids which can suck a sufficient amount of air into the inside thereof when the air-containing elastic layer is in the expanded state. Furthermore, since the voids are open to the atmosphere so that air can freely go in and out thereof, the air-containing elastic layer sucks and discharges air each time the tubular air bags 3 are inflated and deflated to achieve ventilation between the human body surface and the mat body. Pressurized air in the part not compressed by the human body surface on the tubular air bags 3 is naturally discharged out in the air discharge step until the air in that part comes to equilibrium with the external atmospheric pressure and after that almost the whole amount of air remains in the tubular air bags. Therefore, pressurized air required for the next inflation step of each tubular air bag 3 is only the required additional amount of air to be added to the remaining air.

In other words, such an air mat apparatus is advantageous in that compressing or massaging effect can be obtained at the same time while efficiently ventilating wet air between the human body surface and the mat. Also, it is inexpensive since pressurized air consumption is small and no air discharge pump is required. Furthermore, the air mat apparatus is safe since human body heat is not excessively lost.

What is claimed is:

1. An air mat apparatus, comprising:

a mat body having an upper surface and a plurality of defined air chambers;

an air source means for feeding air to each of the air chambers in the mat body;

a changeover valve connected between the plurality of defined air chambers in the mat body and the air source means, said changeover valve having a discharge side which is open to the atmosphere;

an air-containing elastic layer laid only on the upper surface of the mat body;

said air-containing elastic layer having such elasticity as to change its thickness when compressed by the body of a user;

said air-containing elastic layer further having therein channels which are open to the atmosphere; and said air-containing elastic layer further having an uneven lower surface provided with a plurality of projection means, aligned alternately with the channels, for aiding in the deflation of the plurality of defined air chambers in the mat body laying thereunder.

2. An air mat apparatus as claimed in claim 1, in which the air-containing elastic layer is formed of a continuously foamed synthetic resin without having any unfoamed surface layer.

3. An air mat apparatus as claimed in claim 2, in which the air-containing elastic layer is formed of soft polyurethane foam.

4. An air mat apparatus as claimed in claim 1, in which the air-containing elastic layer is formed of non-woven fabric.

* * * * *